US006750598B2

(12) United States Patent
Hori

(10) Patent No.: US 6,750,598 B2
(45) Date of Patent: Jun. 15, 2004

(54) SPARK PLUG

(75) Inventor: Tsunenobu Hori, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/368,006

(22) Filed: Feb. 19, 2003

(65) Prior Publication Data

US 2003/0155849 A1 Aug. 21, 2003

(30) Foreign Application Priority Data

Feb. 19, 2002 (JP) ..... 2002-041501
Dec. 5, 2002 (JP) ..... 2002-353846

(51) Int. Cl.[7] ..... H01T 13/20
(52) U.S. Cl. ..... 313/141; 313/144
(58) Field of Search ..... 313/141, 144

(56) References Cited

U.S. PATENT DOCUMENTS 4,109,633 A 8/1978 Mitsudo et al.
6,094,000 A 7/2000 Osamura et al.

FOREIGN PATENT DOCUMENTS

JP 52-36237 3/1977
JP 8-298178 11/1996
JP 2877035 1/1999

*Primary Examiner*—Vip Patel
(74) *Attorney, Agent, or Firm*—Nixon & Vanderhye P.C.

(57) ABSTRACT

A noble metallic tip of a ground electrode protrudes from an opposed surface of the ground electrode by a protrusion amount 't' not less than 0.3 mm. The noble metallic tip of the ground electrode possesses excellent oxidative and volatile resistance compared with a noble metallic tip of a center electrode.

12 Claims, 15 Drawing Sheets

FIG. 12

| TIP COMPOSITION / WELDING METHOD | 100Pt | Pt-20Rh | Pt-20Ir | Pt-20Pd | Pt-20Ni | Pt-10Ir-10Rh | Pt-10Ir-10Ni |
|---|---|---|---|---|---|---|---|
| RESISTANCE WELDING | ○ | △ | × | ○ | ○ | △ | ○ |
| LASER WELDING | ○ | ○ | ○ | ○ | ○ | ○ | ○ |

SPARK PLUG

BACKGROUND OF THE INVENTION

The present invention generally relates to a spark plug, and more particularly to a spark plug used for an internal combustion engine, which includes noble metallic tips bonded to a center electrode and a ground electrode so as to possess excellent ignitability and is capable of improving exhaustion resistance of these noble metallic tips even when subjected to severe thermal loads.

To assure excellent ignitability, U.S. Pat. No. 4,109,633 discloses a spark plug equipped with center and ground electrodes being configured into a slender structure so as to protrude from electrode support portions.

Furthermore, to assure exhaustion resistance for the electrodes, there is a conventional slender structure which includes noble metallic tips made of Pt, Pd, Au, or their alloys which are fixed to opposed surfaces of the center and ground electrodes.

However, from the recent trends of higher power output, low fuel consumption, and low exhaust gas emissions, the spark plugs of the engines are forced to be exposed to high-temperature combustion environment and, accordingly, the electrode temperature of the spark plug extremely increases.

Furthermore, when a ground electrode employs a slender structure including a protruding noble metallic tip, this noble metallic tip tends to become a heat spot where the exhaustion of tip material accelerates. Hence, the lifetime of spark plug becomes very short.

SUMMARY OF THE INVENTION

In view of the foregoing problems of the prior art, the present invention has an object to provide a spark plug including noble metallic tips fixed to opposed surfaces of center and ground electrodes disposed in an opposed relationship via a discharge gap and capable of assuring excellent exhaustion resistance of these noble metallic tips.

The inventor of this application has earnestly conducted research and development to overcome the foregoing problems. In general, the exhaustion of a noble metallic tip can be regarded as co-occurrence of spark exhaustion resulting from melting or fusion of a noble metallic tip caused by discharge energy, and oxidative and volatile exhaustion resulting from oxidation and volatilization of a noble metallic tip in high-temperature environments. When compared, the center electrode and the ground electrode are different from each other in the exhaustion mechanism of their noble metallic tips. Thus, there is a significantly difference between the center electrode and the ground electrode in the ratio of the spark exhaustion to the oxidative and volatile exhaustion. Regarding the mechanism of the oxidative and volatile exhaustion, the oxidative and volatile exhaustion is believed to occur in a high-temperature atmosphere in such a manner that an oxide film is first formed on a tip surface and then the oxide film falls off the noble metallic tip.

In general, the noble metallic tip of a center electrode has minus polarity, and accordingly the percentage of spark exhaustion is relatively large while the percentage of oxidative and volatile exhaustion is small. On the other hand, the noble metallic tip of a ground electrode has a higher temperature compared with the noble metallic tip of a center electrode. Accordingly, the percentage of oxidative and volatile exhaustion is large. The percentage of spark exhaustion is relatively small because the noble metallic tip of a ground electrode has plus polarity.

Considering the above facts (i.e., the differences in their exhaustion mechanisms), the inventor have experimentally optimized the material composition for each of the noble metallic tip of a center electrode and the noble metallic tip of a ground electrode.

More specifically, in order to accomplish the above and other related objects, the present invention provides a first spark plug including a center electrode, a ground electrode disposed in an opposed relationship with the center electrode via a discharge gap, a noble metallic tip fixed to an opposed surface of the center electrode, and a noble metallic tip fixed to an opposed surface of the ground electrode, wherein the noble metallic tip of the ground electrode protrudes from the opposed surface of the ground electrode by a protrusion amount 't' not less than 0.3 mm, and the noble metallic tip of the ground electrode possesses excellent oxidative and volatile resistance compared with the noble metallic tip of the center electrode.

Preferably, an oxidized and volatilized ratio X, being defined as a ratio Lmax2/Lmax1, is not greater than 0.8 (i.e., $X \leqq 0.8$), where Lmax1 represents a maximum oxidized and volatilized width of the noble metallic tip of the center electrode and Lmax2 represents a maximum oxidized and volatilized width of the noble metallic tip of the ground electrode observed after the noble metallic tip of the center electrode and the noble metallic tip of the ground electrode are left in the air for 30 hours at the temperature of 1,100° C.

Furthermore, it is preferable that the noble metallic tip of the ground electrode has a cross-sectional area 'A' not less than 0.1 $mm^2$ and not greater than 1.15 $mm^2$, and the protrusion amount 't' is not greater than 1.5 mm.

Furthermore, to improve the oxidative and volatile resistance of the noble metallic tip of the ground electrode, the inventor has come across an idea of adopting a noble metallic tip containing an additive which is so easily oxidized to form an oxide film covering or protecting the surface of the noble metallic tip.

Hence, the inventor has conducted endurance tests by varying the content of the additive to check the influence of additive given to the exhaustion resistance of a noble metallic tip made of an Ir alloy which has higher melting point. Based on such experimental research, the invention proposes to employ the following spark plug arrangement.

More specifically, the present invention provides a second spark plug including a center electrode, a ground electrode disposed in an opposed relationship with the center electrode via a discharge gap, a noble metallic tip fixed to an opposed surface of the center electrode, and a noble metallic tip fixed to an opposed surface of the ground electrode, wherein the noble metallic tip of the ground electrode protrudes from the opposed surface of the ground electrode by a protrusion amount 't' not less than 0.3 mm, each of the noble metallic tip of the center electrode and the noble metallic tip of the ground electrode is made of an iridium alloy which contains iridium whose content exceeds 50% by weight and also contains at least one kind of additive, and a total amount of all additives contained in the noble metallic tip of the ground electrode is not less than 15% by weight.

Furthermore, the inventor has conducted endurance tests to optimize the weight percentage of all additives contained in the noble metallic tip of the ground electrode. Based on such experimental research, the invention proposes to employ the following spark plug arrangement.

Namely, according to the second spark plug of the present invention, it is preferable that the total weight percentage of all additives contained in the noble metallic tip of the ground electrode is 1.5 times or more a total weight percentage of all additives contained in the noble metallic tip of the center electrode.

Furthermore, the present invention provides a third spark plug including a center electrode, a ground electrode disposed in an opposed relationship with the center electrode via a discharge gap, a noble metallic tip fixed to an opposed surface of the center electrode, and a noble metallic tip fixed to an opposed surface of the ground electrode, wherein the noble metallic tip of the ground electrode protrudes from the opposed surface of the ground electrode by a protrusion amount 't' not less than 0.3 mm, and the noble metallic tip of the center electrode is made of an iridium alloy which contains iridium whose content exceeds 50% by weight and also contains at least one kind of additive, and the noble metallic tip of the ground electrode is made of a platinum alloy which contains platinum whose content exceeds 50% by weight and also contains at least one kind of additive.

Furthermore, according to the second or third spark plug of the present invention, it is preferable that the noble metallic tip of the ground electrode has a cross-sectional area 'A' not less than 0.1 $mm^2$ and not greater than 1.15 $mm^2$, and the protrusion amount 't' is not greater than 1.5 mm.

Furthermore, according to the second or third spark plug of the present invention, it is preferable that the additive contained in the noble metallic tips of the center electrode and the ground electrode is selected from the group consisting of Ir (iridium), Pt (platinum), Rh (rhodium), Ni (nickel), W (tungsten), Pd (palladium), Ru (ruthenium), Os (osmium), Al (aluminum), Y (yttrium), $Y_2O_3$ (yttrium oxide), and Re (rhenium).

Furthermore, according to the third spark plug of the present invention, it is preferable that all additives contained in the noble metallic tip of the ground electrode has a melting point higher than that of Pt.

Furthermore, according to the third spark plug of the present invention, it is preferable that all additives contained in the noble metallic tip of the ground electrode has a linear expansion coefficient smaller than that of Pt, and the noble metallic tip of the ground electrode is fixed to the opposed surface of the ground electrode by laser welding.

BRIEF DESCRIPTION OF THE DRAWINGS

The above and other objects, features and advantages of the present invention will become more apparent from the following detailed description which is to be read in conjunction with the accompanying drawings, in which:

FIG. 12 is a table showing the relationship between various ground electrode tip compositions and measured bonding reliability of the spark plug in accordance with the present invention;

FIGS. 13A and 13B are views explaining a peel evaluation method employed for measuring the bonding reliability shown in FIG. 12, wherein FIG. 13A is a cross-sectional view showing a ground electrode tip bonded by resistance welding and FIG. 13B is a cross-sectional view showing a ground electrode tip bonded by laser welding;

DESCRIPTION OF THE PREFERRED EMBODIMENTS

Figure 1:
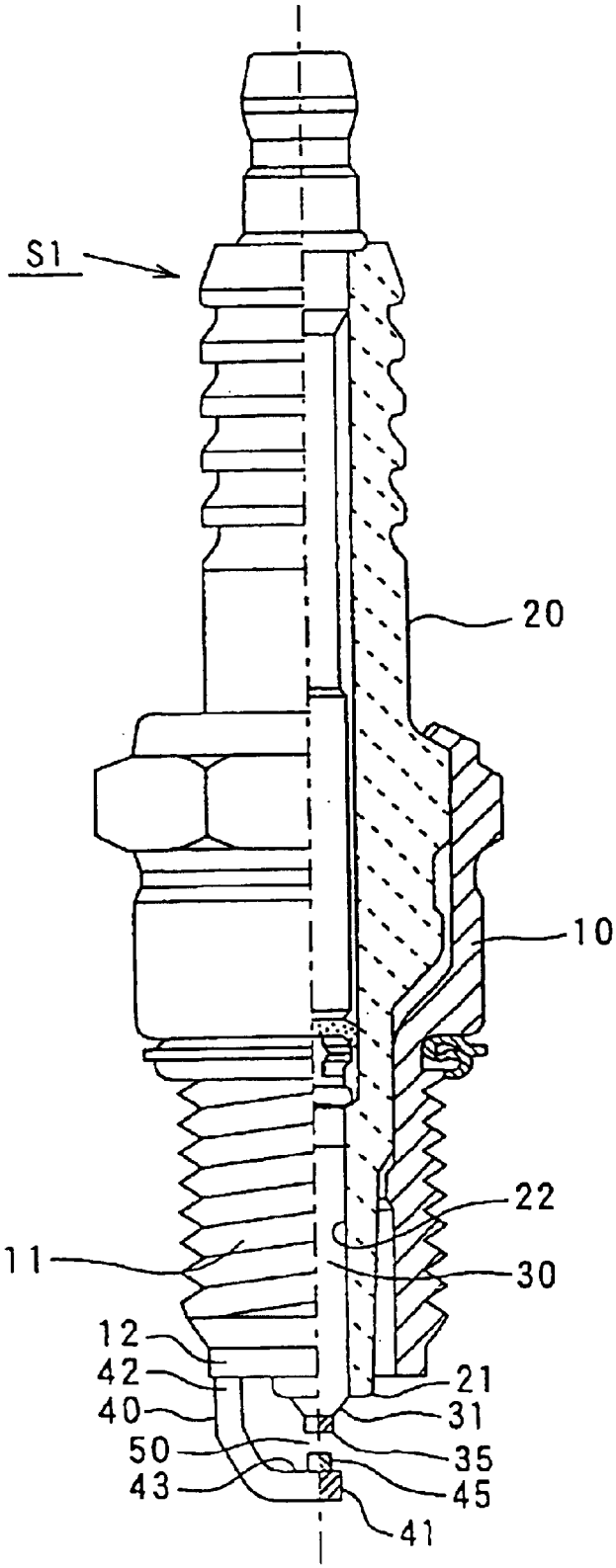
FIG. 1 is a half cross-sectional view showing an overall arrangement of a spark plug for an internal combustion engine in accordance with a preferred embodiment of the present invention.

Preferred embodiments of the present invention will be explained hereinafter with reference to attached drawings. Identical parts are denoted by the same reference numerals throughout the drawings.

FIG. 1 shows a half cross-sectional view of a spark plug S1 applicable to an internal combustion engine in accordance with a preferred embodiment of the present invention. The spark plug S1 is generally inserted into a screw hole formed in an engine head (not shown) and securely fixed to a predetermined position so as to be exposed to a combustion chamber of an engine defined by the engine head and an engine block.

The spark plug S1 includes a center electrode 30 located on the center axis thereof and a ground electrode 40 fixed to an axial end 12 of a cylindrical metallic housing 10. The cylindrical metallic housing 10 is made of an electrically conductive steel material, such as a low-carbon steel plate. The metallic housing 10 has a threaded portion 11 engaged with the screw hole of the engine head. An insulator 20, made of an alumina ceramic ($Al_2O_3$) etc., is securely disposed inside the metallic housing 10. One end (i.e., distal end) 21 of insulator 20 protrudes out of an axial end 12 of the metallic housing 10.

The center electrode 30 is securely supported in an axial hole 22 of the insulator 20. In other words, the insulator 20 is insulated from the metallic housing 10 via the insulator 20. The center electrode 30 is a metallic rod member configured into a cylindrical shape including an internal layer made of Cu or a comparable metallic member having excellent thermal conductivity and an external layer made of a Ni-based alloy or a comparable metallic member possessing excellent heat resistance and corrosion resistance. As shown in FIG. 1, one end (i.e., distal end) 31 of center electrode 30 protrudes out of the one end 21 of insulator 20.

The ground electrode 40 is a metallic rod member configured into a curved square rod or the like. One end (i.e., distal end) 41 of ground electrode 40 is opposed to the one end 31 of center electrode 30 via a discharge gap 50. The ground electrode 40 is bent at its intermediate portion and welded (by resistance welding) to the axial end 12 of the metallic housing 10 at the other end (i.e., proximal end) 42.

Figure 2:
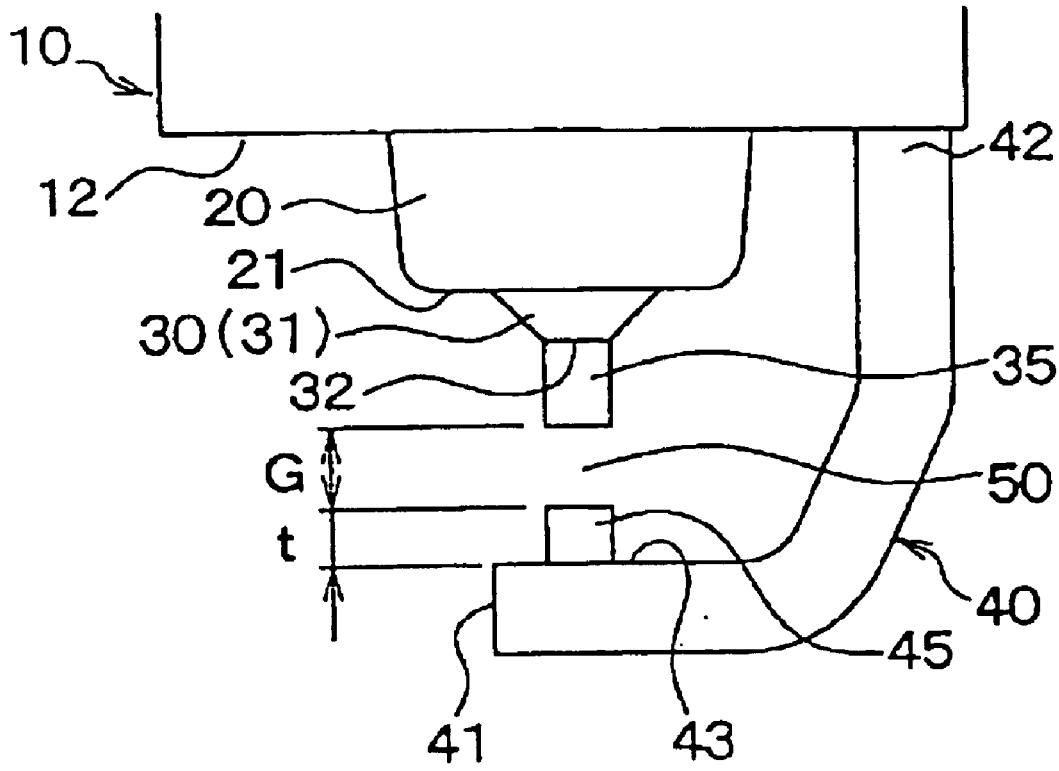
FIG. 2 is an enlarged view explaining the positional relationship between a center electrode and a ground electrode of the spark plug shown in FIG. 1.

FIG. 2 shows a positional relationship between the center electrode 30 and the ground electrode 40 opposed via the discharge gap 50. An end surface 32 of one end 31 of center electrode 30 is disposed so as to oppose an end surface 43 of one end 41 of ground electrode 40. Hereinafter, two end surfaces 32 and 43 are referred to as opposed surfaces of the center electrode 30 and the ground electrode 40, respectively.

A noble metallic tip 35 is fixed on the opposed surface 32 of center electrode 30 by resistance welding or laser welding. Similarly, a noble metallic tip 45 is fixed on the opposed surface 43 of ground electrode 40 by resistance welding or laser welding. Each of the noble metallic tips 35 and 45 is configured into a cylindrical shape.

Hereinafter, the noble metallic tip 35 of center electrode 30 is referred to as center electrode tip and the noble metallic tip 45 of ground electrode 40 is referred to as ground electrode tip.

To realize a slender structure of a discharge section and assure excellent ignitability, the ground electrode tip 45 protrudes from the opposed surface 43 of ground electrode 40 by a protrusion amount 't' toward the center electrode 30. The discharge gap 50 is defined as a shortest clearance or gap G between the center electrode tip 35 and the ground electrode tip 45. For example, the shortest clearance or gap G of discharge gap 50 is set to approximately 1 mm.

According to the above-described spark plug S1, when a predetermined voltage is applied between the center and ground electrodes 30 and 40, electric discharge occurs in the discharge gap 50 defined between the noble metallic tips 35 and 45 of the center and ground electrodes 30 and 40. The spark caused by the electric discharge ignites an air-fuel mixture gas confined in the combustion chamber. A flame core is formed in the discharge gap 50 upon ignition and grows throughout the combustion chamber to promote the combustion of the air-fuel mixture.

The spark plug S1 of this embodiment has the following characteristic arrangement.

First Arrangement

The first arrangement is characterized in that the ground electrode tip 45 protrudes from the opposed surface 43 of ground electrode 40 by the protrusion amount 't' not less than 0.3 mm, and the ground electrode tip 45 possesses excellent oxidative and volatile resistance compared with the center electrode tip 35. Hereinafter, the reasons for employing the first arrangement will be explained with reference to FIGS. 3 and 4.

Figure 3:
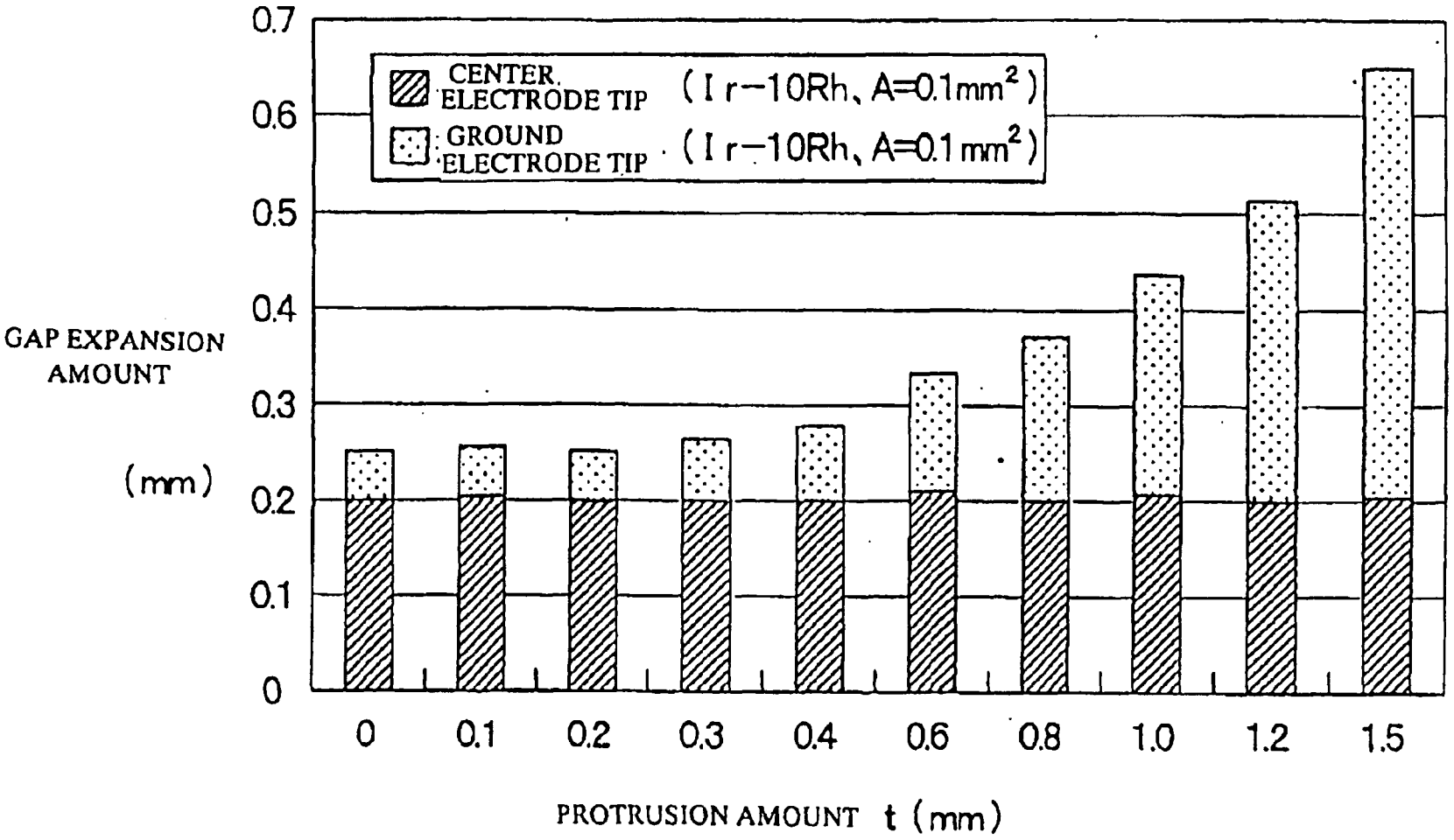
FIG. 3 is a graph showing the relationship between a protrusion amount 't' of a ground electrode tip and a gap expansion amount obtained through engine endurance tests using the spark plug in accordance with the present invention.

FIG. 3 is a graph showing the relationship between the protrusion amount 't' of the ground electrode tip 45 and a gap expansion amount, as an evaluation result obtained from engine endurance tests performed to check the influence of the protrusion amount 't' of the ground electrode tip 45 given to the lifetime of a spark plug.

The engine endurance test was performed for 800 hours based on a high-speed simulation pattern combining an idling condition (900 rpm) and a throttle full-opened condition (5,000 rpm). In other words, the conducted engine endurance test is equivalent to approximately $10\times10^4$ km in terms of the traveling distance of an automotive vehicle.

The gap expansion amount is a variation of discharge gap 50, i.e., a difference between an enlarged discharge gap measured after the endurance test and an initial discharge gap measured before the endurance test. The gap expansion amount of the discharge gap 50, corresponding to each protrusion amount 't' in FIG. 3, is a summation of a gap expansion amount (i.e., the region indicated by solid line hatching) caused by exhaustion of the center electrode tip 35 and a gap expansion amount (i.e., the region indicated by dot hatching) caused by exhaustion of the ground electrode tip 45.

For example, when the protrusion amount 't' is 1.5 mm, the gap expansion amount caused by exhaustion of the center electrode tip 35 is 0.2 mm, while the gap expansion amount caused by exhaustion of the ground electrode tip 45 is 045 mm. The total gap expansion amount is 0–65 mm (=0.2 mm+0.45 mm).

According to the spark plugs used for the endurance tests shown in FIG. 3, each of the noble metallic tips 35 and 45 has a cross-sectional area 'A' of 0.1 $mm^2$ and is made of an Ir-10Rh alloy containing Ir by 90 wt % and Rh by 10 wt %. The above dimensions and materials are set to relatively severe levels in preventing exhaustion of the noble metallic tips 35 and 45. In this case, the cross-sectional area 'A' is taken along a plane normal to the axis of the rod-like metallic tip, i.e., normal to the protruding direction of the metallic tip.

Furthermore, any spark plug having no protrusion amount (i.e., t=0) is regarded as being equivalent to a conventional spark plug even if the ground electrode tip 45 is buried in the opposed surface 43 of ground electrode 40. According to a conventional spark plug having a protruding ground electrode tip, the protruding ground electrode tip becomes a heat spot from which exhaustion is accelerated and, therefore, such a spark plug cannot be practically used.

From FIG. 3, it is understood that, according to a conventional spark plug (t=0), the gap expansion amount (i.e., exhaustion) of the center electrode tip 35 is greater than the gap expansion amount (i.e., exhaustion) of the ground electrode tip 45. The ratio of the exhaustion of center electrode tip 35 to the exhaustion of ground electrode tip 45 is 4:1. It is generally believed that spark exhaustion chiefly occurs at the center electrode 30 because of its minus polarity. Thus, the percentage of spark exhaustion at the center electrode tip 35 is greater than that of spark exhaustion at the ground electrode tip 45.

On the contrary, according to the spark plug including the ground electrode tip 45 protruding from the opposed surface 43 of ground electrode 40, the gap expansion amount (i.e., exhaustion) of the ground electrode tip 45 increases with increasing protrusion amount 't'. In other words, the lifetime of a spark plug becomes short with increasing protrusion amount 't'. This is because, as described above, the ground electrode tip 45 protruding excessively from the opposed surface 43 becomes a heat spot where the temperature locally increases and accordingly the oxidative and volatile exhaustion is promoted.

Figure 4:
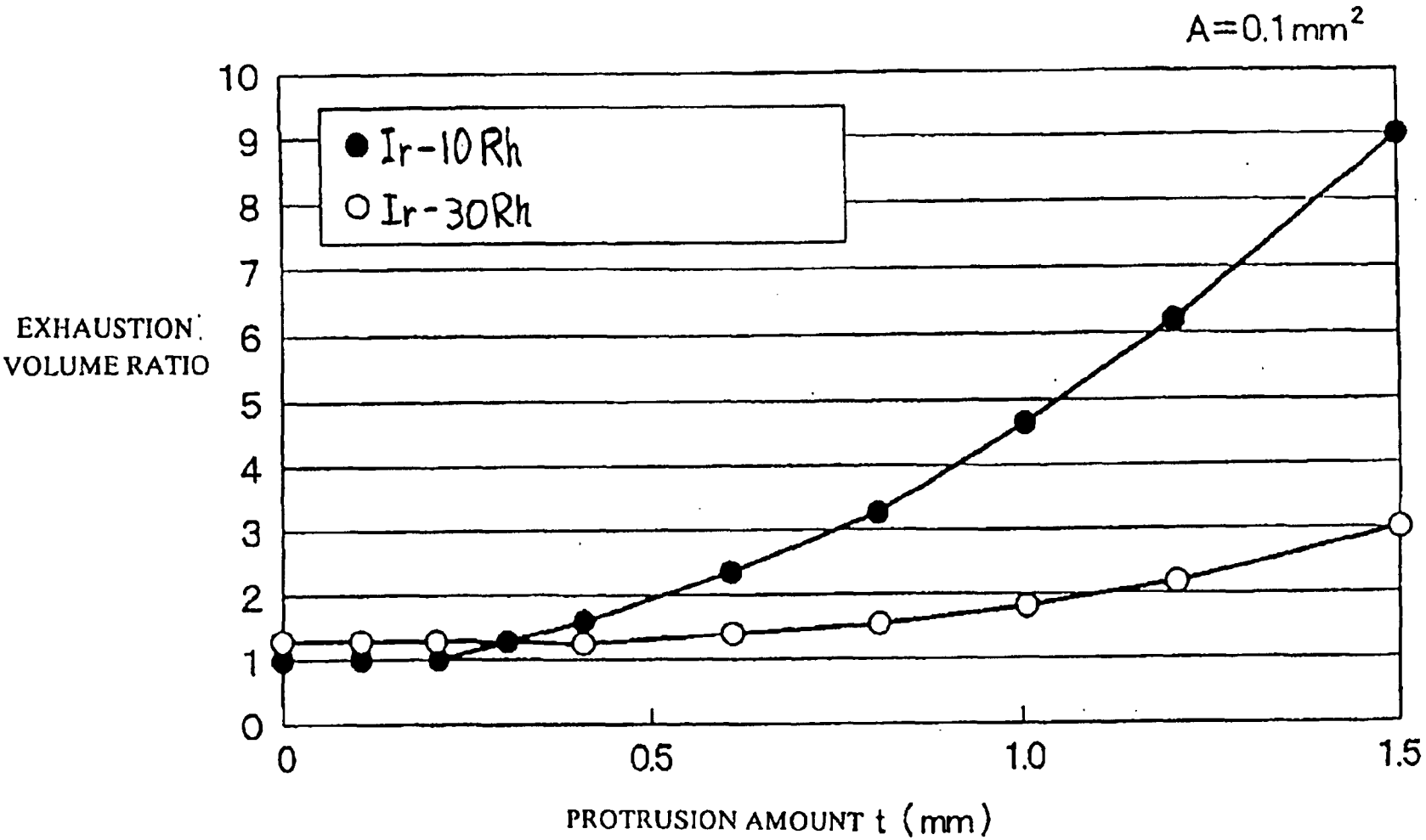
FIG. 4 is a graph showing the relationship between the protrusion amount 't' of the ground electrode tip and an exhaustion volume ratio of the ground electrode tip obtained through engine endurance tests using the spark plug in accordance with the present invention.

FIG. 4 is a graph showing the relationship between the protrusion amount 't' of the ground electrode tip 45 and an exhaustion volume ratio of the ground electrode tip 45 calculated based on the result of the engine endurance tests using the spark plug of this embodiment.

In FIG. 4, black dot marks represent the data of spark plugs including the ground electrode tip 45 and the center electrode tip 35 which are made of the same material having the same composition (i.e., an Ir-10Rh alloy containing Ir by 90 wt % and Rh by 1 wt %). On the other hand, white dot marks represent the data of spark plugs including the ground electrode tip 45 and the center electrode tip 35 which are made of different materials. More specifically, the ground electrode tip 45 is made of an Ir—30Rh alloy containing Ir by 70 wt % and Rh by 30 wt % which has excellent oxidative and volatile resistance compared with the Ir-10Rh alloy of the center electrode tip 35. Each of the noble metallic tips 35 and 45 has a cross-sectional area 'A' of 0.1 $mm^2$. The above dimensions and materials are set to relatively severe levels in preventing exhaustion of the noble metallic tips 35 and 45.

In FIG. 4, the exhaustion volume ratio is expressed as exhaustion volume of each ground electrode tip 45 having the protrusion amount 't' ($0\ mm \leqq t \leqq 1.5\ mm$) normalized with respect to the exhaustion volume of a referential ground electrode tip 45 made of the Ir-10Rh alloy and having no protrusion amount (t=0). For example, the exhaustion volume ratio of the ground electrode tip 45 made of the Ir-10Rh alloy and having the protrusion amount 't' of 1.5 mm is nine times the exhaustion volume ratio of the ground electrode tip 45 made of the Ir-10Rh alloy and having no protrusion amount (t=0).

As understood from FIG. 4, in the case where the center electrode tip 35 and the ground electrode tip 45 are made of the same material (i.e., Ir-10Rh alloy), the exhaustion amount of the ground electrode tip 45 greatly increases when the protrusion amount 't' exceeds 0.3 mm. This is believed, as described above, that the ground electrode tip 45 becomes a heat spot.

On the other hand, in the case where the ground electrode tip 45 is made of a different material (i.e., Ir—30Rh alloy) having excellent oxidative and volatile resistance compared with the Ir-10Rh alloy, the exhaustion amount of the ground electrode tip 45 can be suppressed to low values ($\leqq 3$) in a wide range of the protrusion amount 't' (t=0~1.5 mm).

The difference found in FIG. 4 can be explained in the following manner. When the protrusion amount 't' is less than 0.3 mm, the ground electrode tip 45 does not become a heat spot and accordingly the tip temperature does not increase so much. In this case, even in the ground electrode tip 45, the percentage of spark exhaustion is large compared with the percentage of oxidative and volatile exhaustion. The Ir—30Rh alloy has a lower melting point compared with the Ir-10Rh alloy and, accordingly, the spark exhaustion durability of Ir—30Rh alloy is inferior to that of Ir-10Rh. This is why the exhaustion volume ratio of the ground electrode tip 45 made of the Ir—30Rh alloy is slightly larger than that of the ground electrode tip 45 made of the Ir-10Rh alloy when the protrusion amount 't' is less than 0.3 mm.

To improve the oxidative and volatile resistance, it is preferable that the noble metal constituting the tip contains an appropriate amount of additive so as to be easily oxidized into an oxide film, serving as a protecting film, covering the entire surface of the tip. To this end, the ground electrode tip 45 contains a larger amount of additive elements capable of increasing the oxidative and volatile resistance compared with the center electrode tip 35.

According to this embodiment, the ground electrode tip 45 made of the Ir—30Rh alloy includes a greater amount of additive (i.e., 30 wt % of Rh) compared with the Ir-10Rh alloy. The increased amount (i.e., 30 wt %) of Rh contained in the ground electrode tip 45 serves as an element enhancing the oxidative and volatile resistance. However, increasing the amount of additives contained in the electrode tip results in reduction of the melting point of the tip. Hence, as long as the protrusion amount 't' is less than 0.3 mm, the exhaustion volume ratio of the Ir—30Rh tip is slightly larger than that of the Ir-10Rh tip.

On the other hand, in the case where the protrusion amount 't' is equal to or greater than 0.3 mm, the ground electrode tip 45 tends to become a hot spot where the temperature increases excessively. The percentage of oxidative and volatile exhaustion becomes larger than the percentage of spark exhaustion Accordingly, using the tip material possessing excellent oxidative and volatile resistance is advantageous in effectively suppressing the exhaustion of the electrode tip.

From the test results shown in FIGS. 3 and 4, this embodiment derives the first arrangement characterized in that the ground electrode tip 45 protrudes from the opposed surface 43 of ground electrode 40 by the protrusion amount 't' not less than 0.3 mm, and the ground electrode tip 45 possesses excellent oxidative and volatile resistance compared with the center electrode tip 35. With the first arrangement, it becomes possible to improve the exhaustion resistance of the ground electrode tip 45. The tip exhaustion amount can be greatly reduced. The lifetime of the spark plug S1 can be greatly extended.

FIG. 4 shows the test data obtained based on the spark plugs having the center electrode tip 35 made of an Ir-10Rh alloy and the ground electrode tip 45 made of an Ir—30Rh alloy. However, the tip materials of this invention are not limited to these alloys. As long as the ground electrode tip 45 has excellent oxidative and volatile resistance compared with the center electrode tip 35, the similar test results will be obtained irrespective of a chief component and the kind of an additive element.

Furthermore, according to the first embodiment, it is preferable that an oxidized and volatilized ratio X, being defined as a ratio Lmax2/Lmax1, is not greater than 0.8 (i.e., $X \leqq 0.8$), where Lmax1 represents a maximum oxidized and volatilized width of the center electrode tip 35 and Lmax2 represents a maximum oxidized and volatilized width of the ground electrode tip 45 observed after the center electrode tip 35 and the ground electrode tip 45 are left in the air for 30 hours at the temperature of 1,100° C.

This is based on the result of evaluation performed to check the oxidative and volatile properties of the ground electrode tip 45. Details of the evaluation result will be explained with reference to FIGS. 5 and 6.

Figure 5:
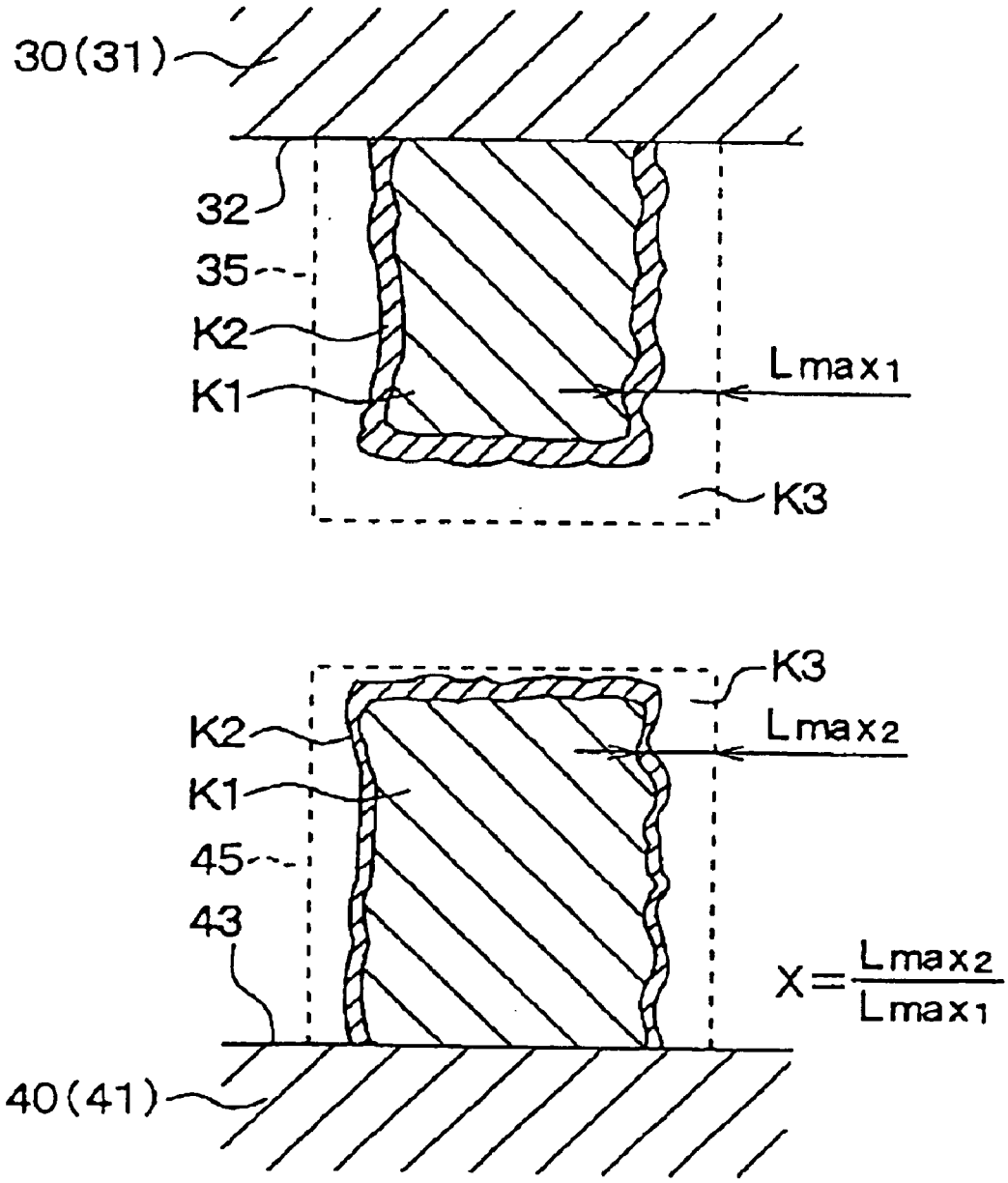
FIG. 5 is a vertical cross-sectional view explaining an evaluation method employed for evaluating the oxidative and volatile properties of the spark plug in accordance with the present invention.

FIG. 5 is a vertical cross-sectional view explaining an evaluation method employed for evaluating the oxidative and volatile properties of the spark plug. According to this method, both of the center electrode tip 35 and the ground electrode tip 45 are left in the air for 30 hours at a high temperature of 1,100° C. Then, the measurement of the maximum oxidized and volatilized width is performed for each of the center electrode tip 35 and the ground electrode tip 45.

The dotted lines of FIG. 5 show the pre-test cross-sectional shape, i.e., the initial shape, of respective electrode tips 35 and 45. When the electrode tips 35 and 45 are left in the high-temperature environment, the volatilization of respective electrode tips 35 and 45 commences from the outer surfaces of their cylindrical rod-like bodies. After having being left in the above-described high-temperature environment, each of respective electrode tips 35 and 45 turns into an exhausted tip consisting of a non-altered region K1 reserving the original material and an oxide layer K2 covering the surface of this non-altered region K1.

As shown in FIG. 5, each of the maximum oxidized and volatilized widths Lmax1 and Lmax2 represents the maximum width of the volatilized portion K3, i.e., the largest clearance between the surface of the initial shape and the surface of the non-altered region K1. Based on such dimensional definitions, the oxidized and volatilized ratio X is defined as a ratio of the maximum oxidized and volatilized width Lmax2 of the ground electrode tip 45 to the maximum oxidized and volatilized width Lmax1 of the center electrode tip 35.

Figure 6:
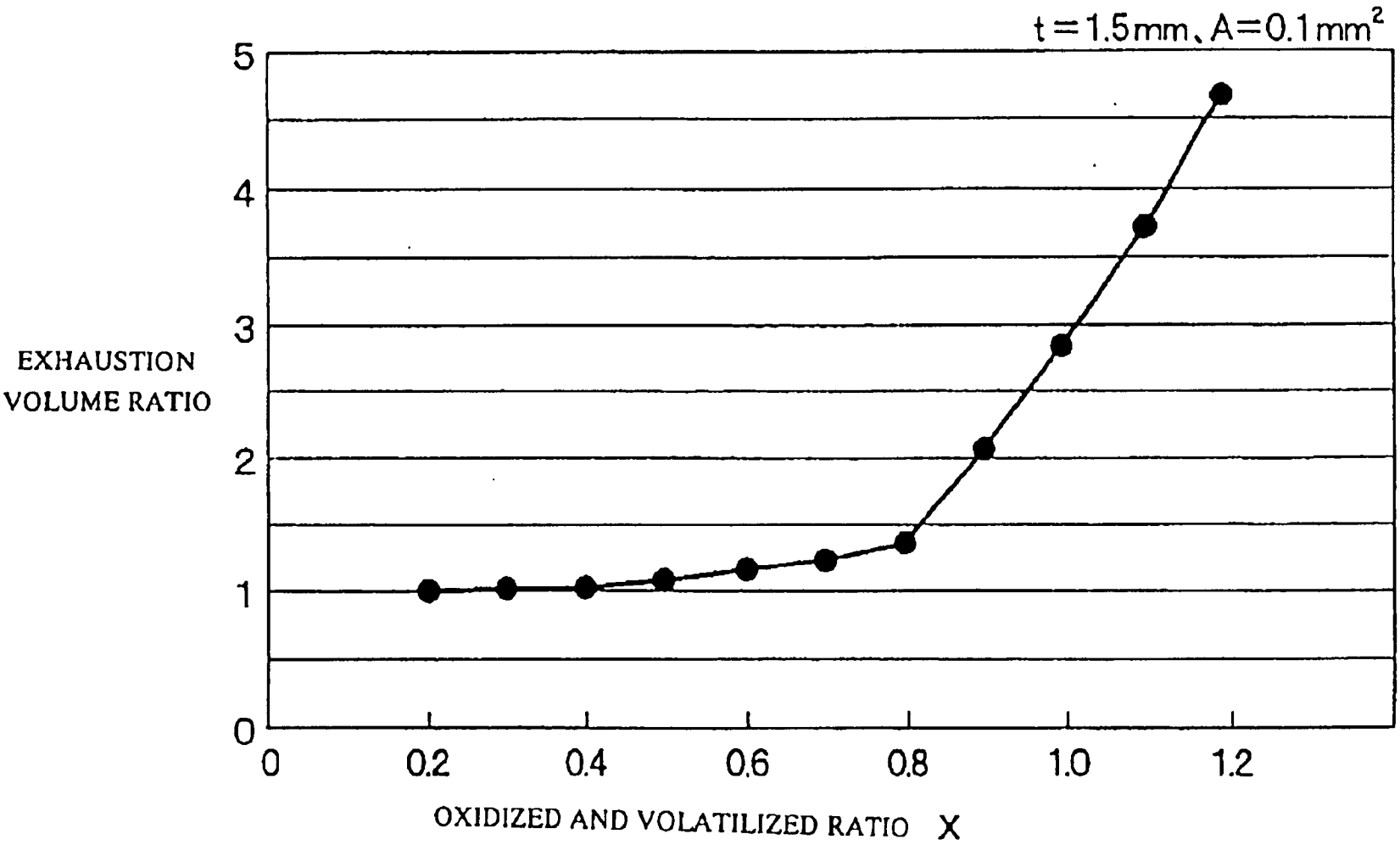
FIG. 6 is a graph showing the relationship between an oxidized and volatilized ratio X and the exhaustion volume ratio of the ground electrode tip obtained through engine endurance tests using the spark plug in accordance with the present invention.

FIG. 6 is a graph showing the relationship between the oxidized and volatilized ratio X and the exhaustion volume ratio of the ground electrode tip 45 calculated based on the result of the engine endurance tests using the spark plug of this embodiment.

In FIG. 6, the exhaustion volume ratio is expressed as exhaustion volume of each ground electrode tip 45 having an oxidized and volatilized ratio X ($0.2 \leqq X \leqq 1.2$) normalized with respect to the exhaustion volume of a referential ground electrode tip 45 having an oxidized and volatilized ratio X of 0.2. The electrode tips 45 used in the evaluations have a cross-sectional area 'A' of 0.1 $mm^2$ and the protrusion amount 't' of 1.5 mm. The center electrode tip 35 and the ground electrode tip 45 are made of the same material having the same component.

As understood from FIG. 6, the exhaustion volume of ground electrode tip 45 greatly increases when the oxidized and volatilized ratio X exceeds 0.8. Accordingly, to greatly reduce the oxidative and volatile exhaustion of the ground electrode tip 45, it is preferable to suppress the oxidized and volatilized ratio X to 0.8 or less.

Figure 7:
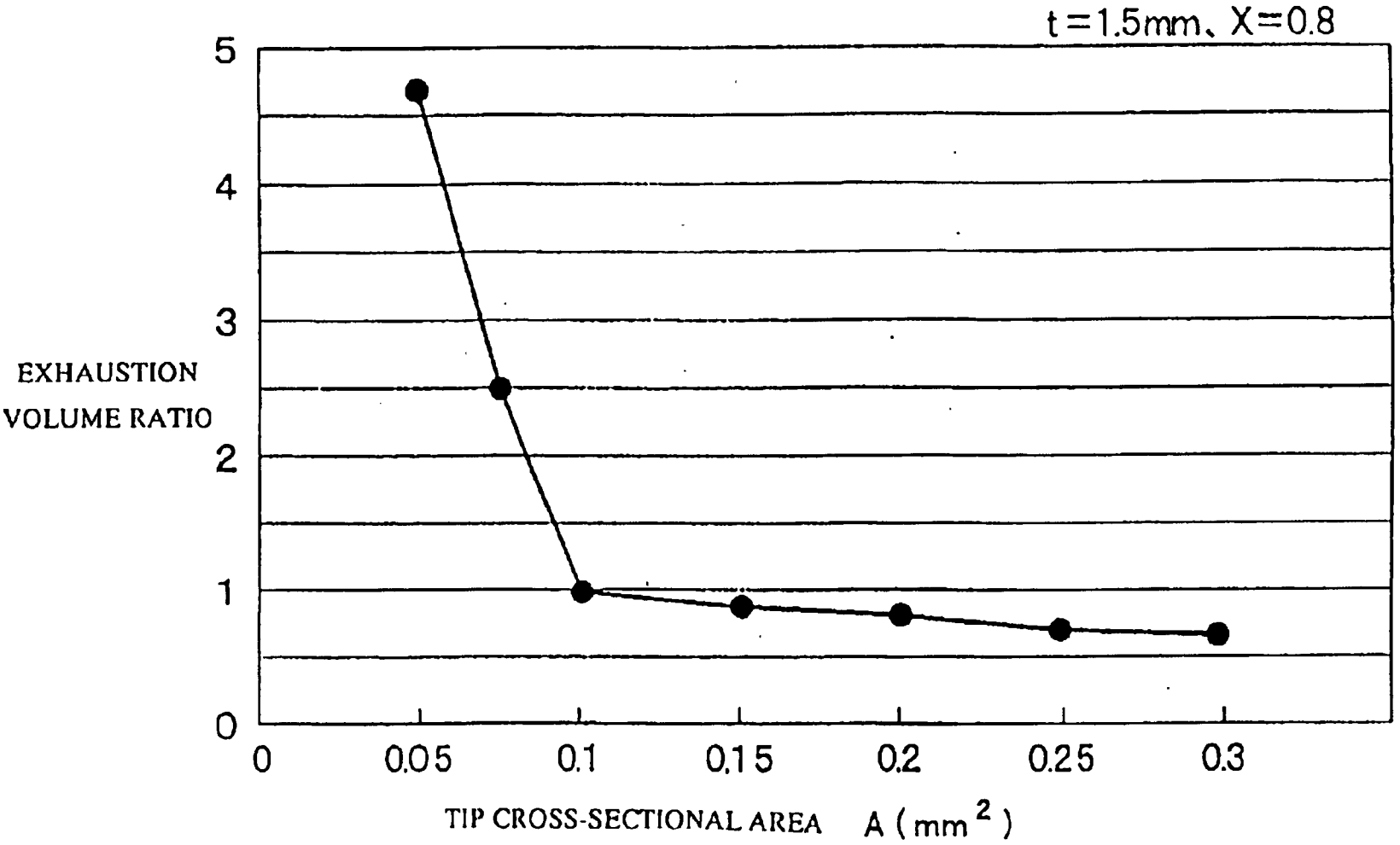
FIG. 7 is a graph showing the relationship between a tip cross-sectional area 'A' of the ground electrode tip and the exhaustion volume ratio of the ground electrode tip obtained through engine endurance tests using the spark plug in accordance with the present invention.
Figure 8:
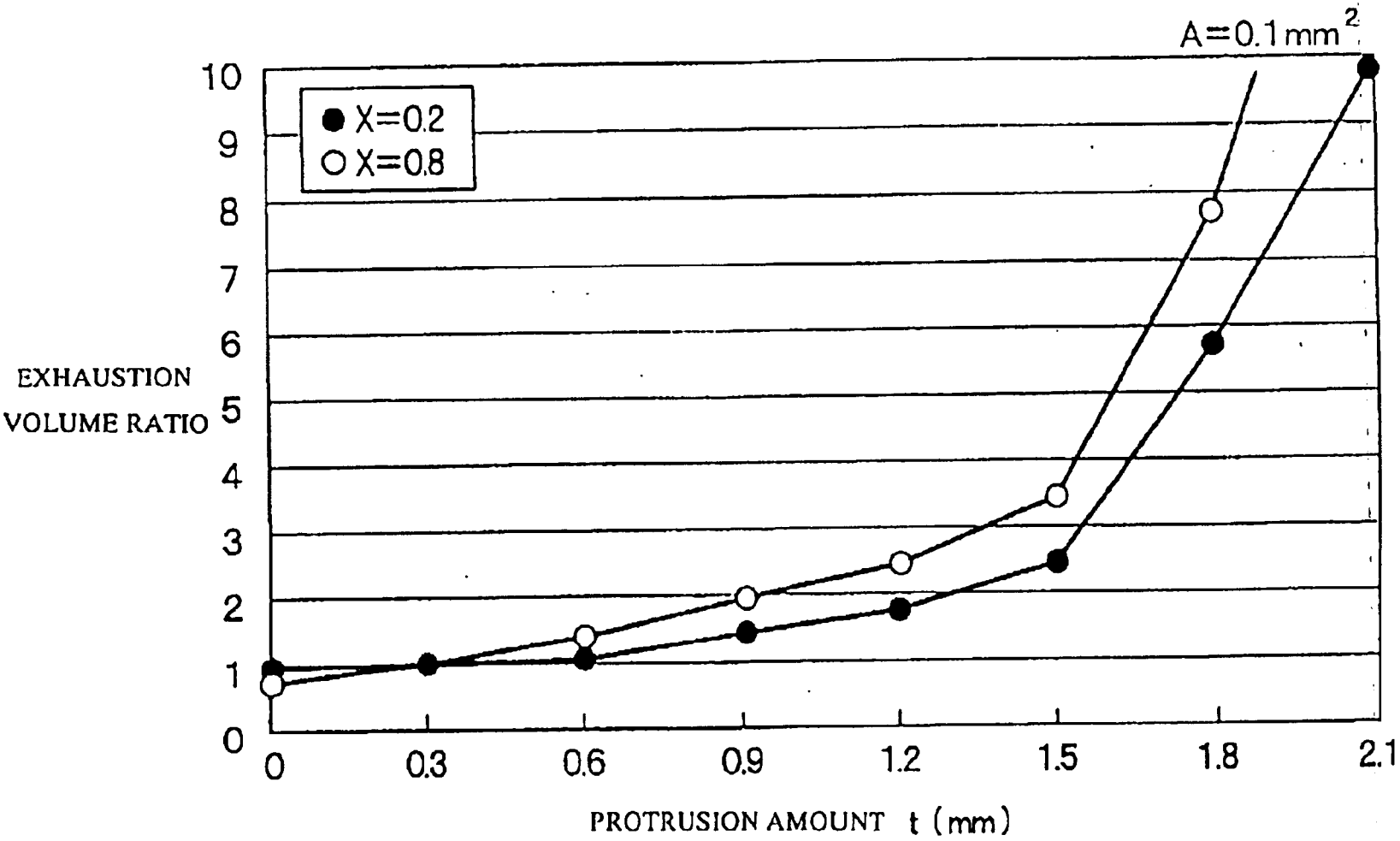
FIG. 8 is a graph showing the relationship between the protrusion amount 't' of the ground electrode tip and the exhaustion volume ratio of the ground electrode tip obtained through engine endurance tests using the spark plug in accordance with the present invention.

Furthermore, according to the first arrangement, it is preferable that the ground electrode tip 45 has a cross-sectional area 'A' not less than 0.1 $mm^2$ and not greater than 1.15 $mm^2$ and the protrusion amount 't' is not greater than 1.5 mm as apparent from the test data shown in FIGS. 7 and 8.

FIG. 7 is a graph showing the relationship between the tip cross-sectional area 'A' of the ground electrode tip 45 and the exhaustion volume ratio of the ground electrode tip 45 obtained through the engine endurance tests using the spark plug of this embodiment.

In FIG. 7, the exhaustion volume ratio is expressed as exhaustion volume of each ground electrode tip 45 having a tip cross-sectional area 'A' ($0.05\ mm^2 \leqq A \leqq 0.3\ mm^2$) normalized with respect to the exhaustion volume of a referential ground electrode tip 45 having a tip cross-sectional area A of 0.1 $mm^2$. The electrode tips 45 used in the evaluations have the protrusion amount 't' of 1.5 mm and an oxidized and volatilized ratio X of 0.8 (i.e., X=0.8).

As understood from FIG. 7, the exhaustion volume of ground electrode tip 45 greatly increases when the tip cross-sectional area 'A' is less than 0.1 $mm^2$. This is believed that the tip temperature promptly increases when the tip cross-sectional area 'A' is excessively small. Thus, it becomes difficult to suppress the oxidative and volatile exhaustion.

Although not shown in FIG. 7, according to the evaluations conducted by the inventor, it is difficult to assure excellent ignitability of a spark plug when the tip cross-sectional area 'A' is larger than 1.15 $mm^2$.

Furthermore, FIG. 8 is a graph showing the relationship between the protrusion amount 't' of the ground electrode tip 45 and the exhaustion volume ratio of the ground electrode tip 45 obtained through the engine endurance tests using the spark plug of this embodiment.

The ground electrode tips 45 used in the evaluations have a cross-sectional area 'A' of 0.1 $mm^2$ and an oxidized and volatilized ratio X of 0.2 or 0.8. In FIG. 8, the exhaustion volume ratio is expressed as exhaustion volume of each ground electrode tip 45 having a protrusion amount 't' ($0\ mm \leqq t \leqq 2.1\ mm$) normalized with respect to the exhaustion volume of a referential ground electrode tip 45 having the protrusion amount 't' of 0.3 mm.

As understood from FIG. 8, the exhaustion volume of ground electrode tip 45 greatly increases when the tip protrusion amount 't' is larger than 1.5 mm irrespective of oxidized and volatilized ratio X. This is believed that the tip temperature promptly increases when the tip protrusion amount 't' is excessively large. Thus, it becomes difficult to suppress the oxidative and volatile exhaustion.

From the foregoing, the evaluation result shown in FIGS. 7 and 8 derives the conclusion that, to assure excellent ignitability, it is preferable that the ground electrode tip 45 has a cross-sectional area 'A' not less than 0.1 $mm^2$ and not greater than 1.15 $mm^2$ and the protrusion amount 't' is not greater than 1.5 mm.

As apparent from the above-described first arrangement, the present invention provides a first spark plug including a center electrode (30), a ground electrode (40) disposed in an opposed relationship with the center electrode via a discharge gap (50), a noble metallic tip (35) fixed to an opposed surface (32) of the center electrode, and a noble metallic tip (45) fixed to an opposed surface (43) of the ground electrode, wherein the noble metallic tip (45) of the ground electrode protrudes from the opposed surface (43) of the ground electrode by a protrusion amount 't' not less than 0.3 mm, and the noble metallic tip (45) of the ground electrode possesses excellent oxidative and volatile resistance compared with the noble metallic tip (35) of the center electrode.

According to the inventor, protruding the noble metallic tip from the opposed surface of the ground electrode improves the ignitability. Regarding the exhaustion pattern of the noble metallic tip of the ground electrode, the percentage of oxidative and volatile exhaustion becomes higher than that of spark exhaustion when the protrusion amount 't' exceeds 0.3 mm (refer to FIGS. 3 and 4).

According to the first spark plug of the present invention, the noble metallic tip (45) of the ground electrode possesses excellent oxidative and volatile resistance compared with the noble metallic tip (35) of the center electrode. Hence, when the protruding amount 't' is equal to or greater than 0.3 mm, the first spark plug of the present invention makes it possible to improve the exhaustion resistance of the noble metallic tip of the ground electrode.

Furthermore, according to the first spark plug of the present invention, it is preferable that an oxidized and volatilized ratio X, being defined as a ratio Lmax2/Lmax1, is not greater than 0.8 (i.e., $X \leqq 0.8$), where Lmax1 represents a maximum oxidized and volatilized width of the noble metallic tip (35) of the center electrode (20) and Lmax2 represents a maximum oxidized and volatilized width of the noble metallic tip (45) of the ground electrode (40) observed after the noble metallic tip (35) of the center electrode (20) and the noble metallic tip (45) of the ground electrode (40) are left in the air for 30 hours at the temperature of 1,100° C.

If the oxidized and volatilized ratio X is less than 1, the noble metallic tip of the ground electrode will substantially possess excellent oxidative and volatile resistance compared with the noble metallic tip of the center electrode. According to the inventor, when the oxidized and volatilized ratio X is not greater than 0.8, the oxidative and volatile exhaustion of the noble metallic tip of the ground electrode reduces greatly (refer to FIG. 6).

Furthermore, according to the first spark plug of the present invention, it is preferable that the noble metallic tip (45) of the ground electrode (40) has a cross-sectional area 'A' not less than 0.1 mm and not greater than 1.15 $mm^2$, and the protrusion amount 't' is not greater than 1.5 mm.

When the cross-sectional area 'A' and the protrusion amount 't' of the noble metallic tip (45) of the ground electrode (40) are in the above-defined ranges respectively, not only the exhaustion resistance can be improved but also excellent ignitability can be obtained.

More specifically, if the cross-sectional area 'A' is less than 0.1 $mm^2$, the exhaustion amount of the noble metallic tip will increase greatly (refer to FIG. 7). On the other hand, if the cross-sectional area 'A' is greater than 1.15 $mm^2$, it will become difficult to assure excellent ignitability. Furthermore, if the protrusion amount 't' is greater than 1.5 mm, the exhaustion amount of the noble metallic tip will increase greatly (refer to FIG. 8).

Second Arrangement

Furthermore, to improve the exhaustion resistance of the noble metallic tips 35 and 45 used in the spark plug S1 according to this embodiment, it is preferable to employ the following second arrangement under the condition that the protrusion amount 't' of ground electrode tip 45 is not less than 0.3 mm.

More specifically, each of the center electrode tip 35 and the ground electrode tip 45 is made of an Ir alloy which contains Ir as chief component whose content exceeds 50% by weight and also contains at least one kind of additive, and a total amount of all additives contained in the ground electrode tip 45 is not less than 15% by weight The following is the reasons why the second arrangement brings preferable properties.

First, using the Ir alloy which contains Ir whose content exceeds 50% by weight and also contains at least one kind of additive for each of the center electrode tip 35 and the ground electrode tip 45 is advantageous to assure excellent properties, such as a higher melting point and an excellent heat resistance, for the tip. Next, limiting the total amount of all additives contained in the ground electrode tip 45 to be not less than 15% by weight and not greater than 50% by weight is derived from the result shown in FIG. 9.

Figure 9:
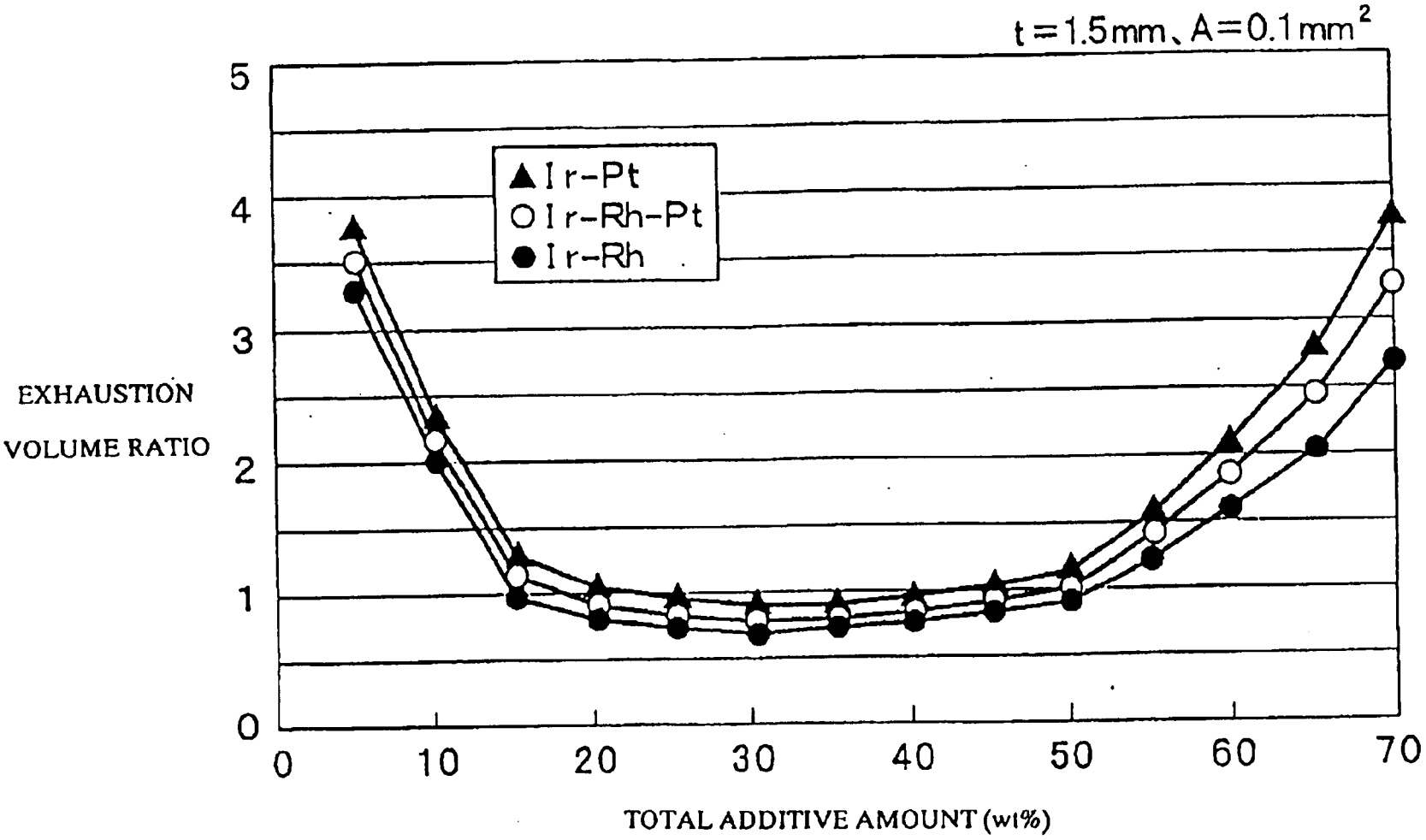
FIG. 9 is a graph showing the relationship between a total additive amount contained in the ground electrode tip and the exhaustion volume ratio of the ground electrode tip obtained through engine endurance tests using the spark plug in accordance with the present invention.

FIG. 9 is a graph showing the relationship between a total additive amount contained in the ground electrode tip 45 and the exhaustion volume ratio of the ground electrode tip 45 obtained through the engine endurance tests using the spark plug of this embodiment.

The test data shown in FIG. 9 are based on three kinds of ground electrode tips 45 which contains Ir as chief material and only one additive selected from the group consisting of Rh, Rh—Pt, and Pt. In FIG. 9, the exhaustion volume ratio is expressed as exhaustion volume of each ground electrode tip 45 containing one of Rh, Rh—Pt, and Pt whose amount ranging from 5 wt % to 70 wt % normalized with respect to the exhaustion volume of a referential ground electrode tip 45 containing Rh of 15 wt %. The ground electrode tips 45 used in the evaluations have the protrusion amount 't' of 1.5 mm and a cross-sectional area 'A' of 0.1 $mm^2$.

As understood from FIG. 9, the exhaustion volume of ground electrode tip 45 greatly increases when the total additive amount is less than 15 wt % irrespective of the kind and number of additive added to Ir. Accordingly, it becomes difficult to suppress the oxidative and volatile exhaustion of the ground electrode tip 45. On the other hand, when the total additive amount is greater than 50 wt %, the melting point of ground electrode tip 45 decreases and the exhaustion volume of ground electrode tip 45 increases greatly.

From the foregoing, the evaluation result shown in FIG. 9 derives the conclusion that, to suppress the exhaustion amount of the ground electrode tip 45 having the protrusion amount 't' less than 0.3 mm, it is preferable that the ground electrode tip 45 is made of an Ir alloy which contains Ir having a higher melting point as chief material (i.e., by the content exceeding 50 wt %) and also contains at least one kind of additive, and a total amount of all additives contained in the ground electrode tip 45 is not less than 15% by weight.

FIG. 9 shows the test data obtained based on the ground electrode tip 45 made of an Ir alloy containing an additive selected from the group consisting of Rh, Rh—Pt, and Pt. However, the additive elements of this invention are not limited to the above elements. The similar test results will be obtained even when the ground electrode tip 45 includes the additive selected from the group consisting of Ni, W, Pd, Ru, Os, Al, Y, $Y_2O_3$, and Re, or even when the ground electrode tip 45 includes three or more kinds of additive elements.

The spark plug S1 employing the above-described second arrangement, instead of employing the above-described first arrangement, makes it possible to realize the ground electrode tip 45 having excellent oxidative and volatile resistance compared with the center electrode tip 35 when the protrusion amount 't' of the ground electrode tip 45 is less than 0.3 mm. Accordingly, the exhaustion resistance of the noble metallic tip can be improved.

Furthermore, according to the above-described second arrangement, it is preferable that the total weight percentage of all additives contained in the ground electrode tip 45 is 1.5 times or more a total weight percentage of all additives contained in the center electrode tip 35. The following is the reasons why this limitation is preferable.

Figure 10:
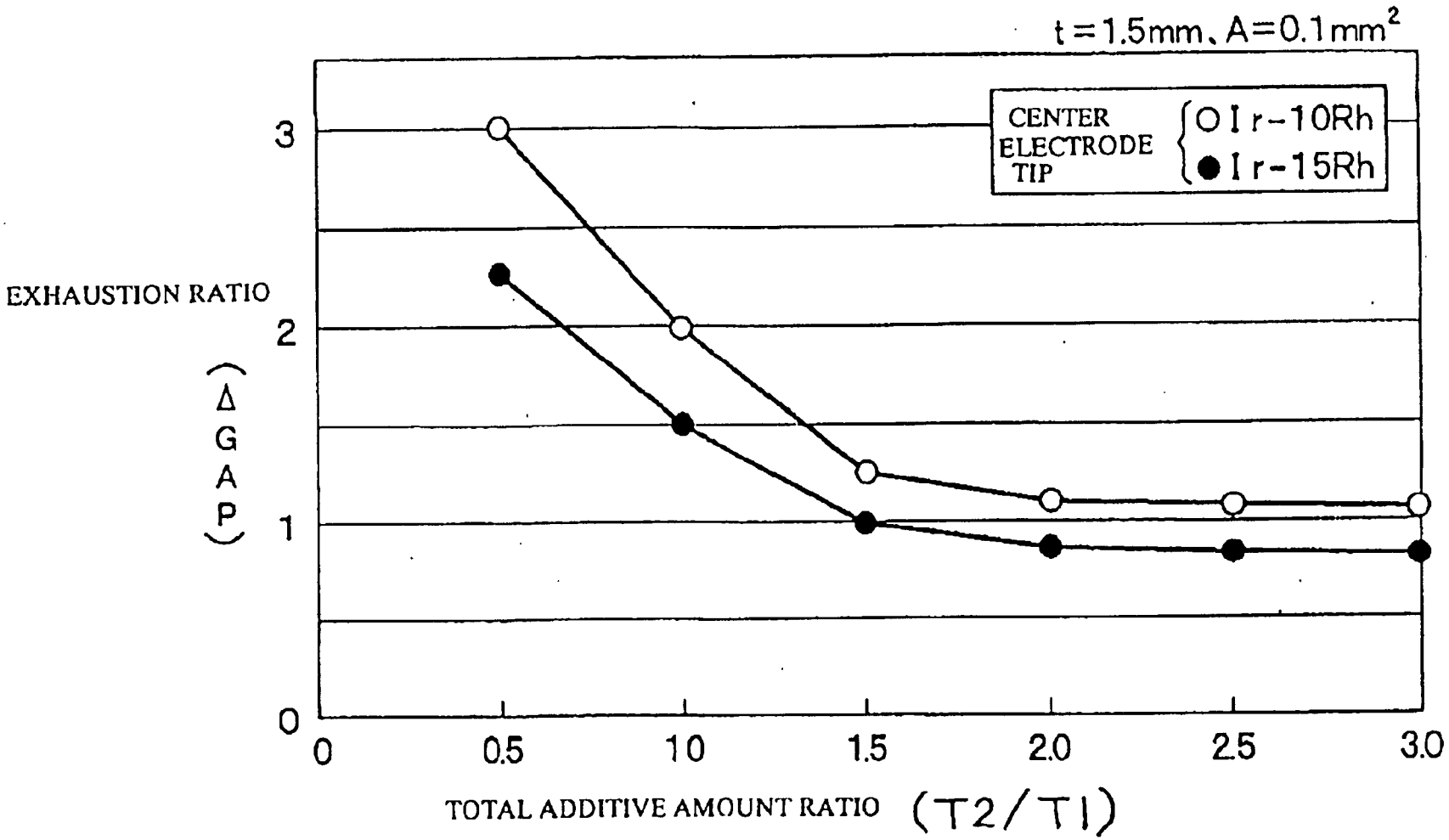
FIG. 10 is a graph showing the relationship between a total additive amount ratio and an exhaustion ratio of the spark plug in accordance with the present invention, where the total additive amount ratio representing a ratio of a total additive amount (wt %) contained in the ground electrode tip to a total additive amount (wt %) contained in the center electrode tip while the exhaustion ratio representing the gap expansion amount.

FIG. 10 is a graph showing the relationship between a total additive amount ratio (T2/T1) and an exhaustion ratio (ΔGAP) of the spark plug in accordance with this embodiment, where the total additive amount ratio (T2/T1) representing a ratio of a total additive amount T2 (wt %) contained in the ground electrode tip 45 to a total additive amount T1 (wt %) contained in the center electrode tip 35 while the exhaustion ratio ΔGAP representing the gap expansion amount.

In FIG. 10, black dot marks represent the data obtained though the engine endurance tests using the center electrode tip 35 made of an Ir-10Rh alloy White dot marks represent the data obtained though the engine endurance tests using the center electrode tip 35 made of an Ir—15Rh alloy. The test conditions for the Ir-10Rh tip were set to be higher than those for the Ir-10Rh tip.

More specifically, according to the engine endurance test of the Ir-10Rh tip, the tip temperature was increased up to 950° C. at one end (i.e., distal end) 41 of ground electrode 40. Meanwhile, according to the engine endurance test of the Ir—15Rh tip, the ignition timing was changed to increase the tip temperature from 950° C. to 1,000° C. In other words, under the condition that the additive amount of the center electrode tip 35 was adjusted to actual use environment of the spark plug, the influence given to the gap expansion amount of the spark plug was checked with respect to the total additive amount ratio.

According to the endurance tests shown in FIG. 10, the ground electrode tip 45 is also made of an Ir—Rh alloy. The total additive amount ratio is defined as a ratio of a weight percentage of Rh contained in the ground electrode tip 45 to a weight percentage of Rh contained in the center electrode tip 35. The ground electrode tips 45 used in the evaluations have the protrusion amount 't' of 1.5 mm and a cross-sectional area 'A' of 0.1 $mm^2$.

Furthermore, the exhaustion ratio is expressed as gap expansion amount of each tested spark plug having a total additive amount ratio ranging from 0.5 to 3.0 normalized with respect to the gap expansion amount of a referential spark plug having the Ir-10Rh center electrode tip 35 having a total additive amount ratio of 1.5. As apparent from the gap expansion amount corresponding to the protrusion amount t=1.5 shown in FIG. 3, exhaustion of ground electrode tip 45 greatly contributes the gap expansion amount.

From the test result shown in FIG. 10, to suppress the oxidative and volatile exhaustion of the ground electrode tip 45 and enlarge the lifetime of spark plug, it is desirable that the total additive amount ratio is 1.5 or more irrespective of additive amount contained in the center electrode tip 35.

FIG. 10 shows the test data obtained based on the Ir alloy tips containing Rh as additive. However, the additive element of this invention is not limited to Rh. The similar test results will be obtained even when the electrode tip includes the additive element selected from the group consisting of Ni, Pt, W, Pd, Ru, Os, Al, Y, and $Y_2O_3$, or even when the kind of additive contained in the center electrode tip 35 is different from the kind of additive contained in the ground electrode tip 45.

As apparent from the foregoing description, to improve the oxidative and volatile resistance of the noble metallic tip of the ground electrode, the inventor has come across an idea of adopting a noble metallic tip containing an additive which is so easily oxidized to form an oxide film covering or protecting the surface of the noble metallic tip.

Hence, the inventor has conducted endurance tests by varying the content of the additive to check the influence of additive given to the exhaustion resistance of a noble metallic tip made of an Ir alloy which has higher melting point. Based on such experimental research, the invention proposes to employ the following spark plug arrangement.

Namely, as explained with reference to the second arrangement, the present invention provides a second spark plug including a center electrode (30), a ground electrode (40) disposed in an opposed relationship with the center electrode via a discharge gap (50), a noble metallic tip (35) fixed to an opposed surface (32) of the center electrode, and a noble metallic tip (45) fixed to an opposed surface (43) of the ground electrode, wherein the noble metallic tip (45) of the ground electrode protrudes from the opposed surface (43) of the ground electrode by a protrusion amount 't' not less than 0.3 mm, each of the noble metallic tip (35) of the center electrode and the noble metallic tip (45) of the ground electrode is made of an iridium alloy which contains iridium whose content exceeds 50% by weight and also contains at least one kind of additive, and a total amount of all additives contained in the noble metallic tip (45) of the ground electrode is not less than 15% by weight.

According to the second spark plug of the present invention, both of the noble metallic tips of center and ground electrodes are made of the iridium alloy containing iridium whose content exceeds 50% by weight and also containing at least one kind of additive. Thus, it becomes possible to assure excellent tip characteristics, such as high melting point and superior heat resistance.

Furthermore, the total amount of all additives contained in the noble metallic tip (45) of the ground electrode is not less than 15% but not greater than 50% by weight. If the total amount of all additives is less than 15% by weight, it will be difficult to suppress the oxidative and volatile exhaustion of the noble metallic tip. On the other hand, if the total amount of all additives is greater than 50% by weight, the melting point of the noble metallic tip will decrease (refer to FIG. 9).

From the foregoing, the second spark plug of the present invention can assure enhanced exhaustion resistance of the noble metallic tip.

Furthermore, the inventor has conducted endurance tests to optimize the weight percentage of all additives contained in the noble metallic tip of the ground electrode. Based on such experimental research, the invention proposes to employ the following spark plug arrangement.

Namely, according to the second spark plug of the present invention, it is preferable that the total weight percentage of all additives contained in the noble metallic tip (45) of the ground electrode (40) is 1.5 times or more a total weight percentage of all additives contained in the noble metallic tip (35) of the center electrode.

Irrespective of the additive amount contained the noble metallic tip of the center electrode, the ratio of the total amount of all additives contained in the noble metallic tip (45) of the ground electrode (40) to the total amount of all additives contained in the noble metallic tip (35) of the center electrode is 1.5 times or more by weight. This makes it possible to suppress the oxidative and volatile exhaustion of the noble metallic tip of the ground electrode. Thus, the lifetime of a spark plug can be extended (refer to FIG. 10).

Third Arrangement

Furthermore, to improve the exhaustion resistance of the noble metallic tips 35 and 45 used in the spark plug S1 according to this embodiment, it is preferable to employ the following third arrangement under the condition that the protrusion amount 't' of ground electrode tip 45 is not less than 0.3 mm.

More specifically, the center electrode tip 35 is made of an Ir alloy which contains Ir as chief component whose content exceeds 50% by weight and also contains at least one kind of additive, and the ground electrode tip 45 is made of a platinum alloy which contains platinum as chief component whose content exceeds 50% by weight and also contains at least one kind of additive.

According to the third arrangement, the center electrode tip 35 is made of an Ir alloy having a higher melting point and the ground electrode tip 45 is made of a Pt alloy having excellent oxidative and volatile resistance. The center electrode tip 35 is chiefly subjected to spark exhaustion. Therefore, using the Ir alloy for the center electrode tip 35 is effective to enhance the durability against the spark exhaustion. The ground electrode tip 45 is chiefly subjected to oxidative and volatile exhaustion. Therefore, using the Pt alloy for the ground electrode tip 35 is effective to enhance the durability against the oxidative and volatile exhaustion.

Therefore, the spark plug S1 employing the third arrangement, instead of employing the first or second arrangement, makes it possible to enhance the exhaustion resistance of noble metallic tips. The lifetime of a spark plug is greatly enlarged.

Furthermore, according to the third arrangement, to increase the tip strength, it is preferable that the electrode tips 35 and 45 include at least one additive selected from the group consisting of Ir, Pt, Rh, Ni, W, Pd, Ru, Os, Al, Y, and $Y_2O_3$. It becomes possible to prevent the tips from causing cracks.

According to the third arrangement, it is also preferable that all additives contained in the ground electrode tip 45 has a melting point higher than that of Pt.

Furthermore, according to the third arrangement, it is preferable that all additives contained in the ground electrode tip 45 has a linear expansion coefficient smaller than that of Pt, and the ground electrode tip is fixed to the opposed surface 43 of the ground electrode 40 by laser welding.

The ground electrode tip 45, made of a Pt alloy containing Pt as chief component, contains at least one kind of additive selected from the group consisting of Ir, Rh, Ni, W, Pd, Ru, Os, Al, $Y_2O_3$, and Re.

Table 1 shows the melting point and the linear expansion coefficient of respective metallic components.

TABLE 1

| | melting point (° C.) | linear expansion coefficient ($0 \times 10^6$/° C.) |
|---|---|---|
| Pt | 1,769 | 9.0 |
| Ir | 2,443 | 6.8 |
| Rh | 1,966 | 8.5 |
| Ni | 1,453 | 13.3 |
| W | 3,400 | 4.5 |
| Pd | 1,552 | 11.0 |
| Ru | 2,250 | 9.6 |
| Os | 3,030 | 4.6 |
| Al | 660 | 23.5 |
| $Y_2O_3$ | 4,300 | 7.2 |
| Re | 3,180 | 6.6 |

Figure 11:
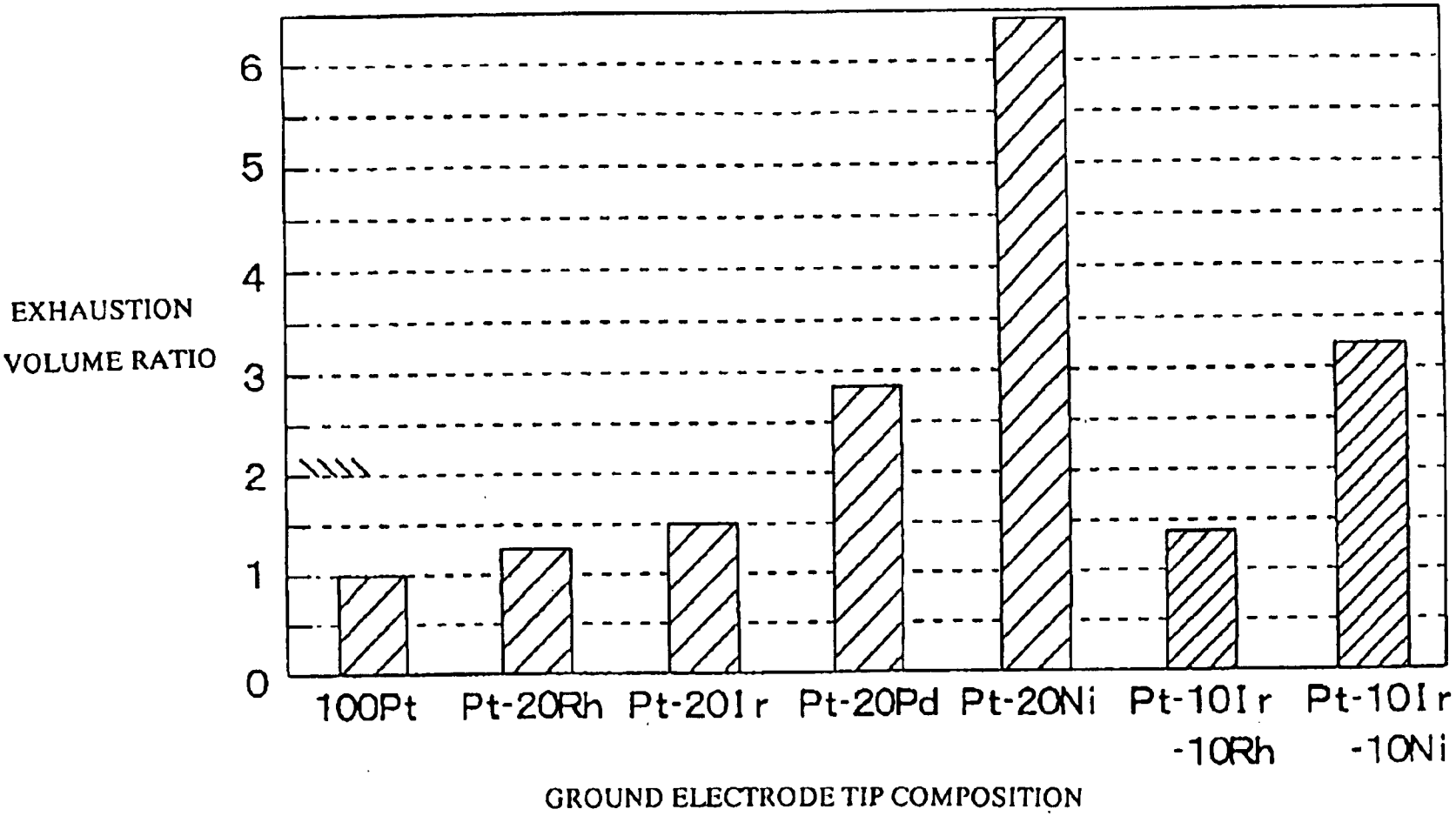
FIG. 11 is a graph showing the relationship between various ground electrode tip compositions and measured spark exhaustion of the spark plug in accordance with the present invention.

FIG. 11 is a graph showing the relationship between various ground electrode tip compositions of the ground electrode tip 45 and experimentally measured exhaustion volume ratio of the spark plug. The exhaustion volume ratio is expressed as exhaustion volume of each tested ground electrode tip 45 normalized with reference to an exhaustion volume of a referential ground electrode tip 45 containing only Pt (i.e., containing no additive).

The test data shown in FIG. 11 are based on the ground electrode tip 45 containing Pt as chief component and an additive selected from the group consisting of Rh, Ir, Pd, Ni, Ir—Rh, and Ir—Ni. To obtain the exhaustion volume ratio shown in FIG. 11, a spark bench endurance test was performed for 700 hours at the room temperature.

Although having excellent spark exhaustion durability, the 100Pt ground electrode tip 45 (containing no additive) is inferior to other tested tips in strength and therefore causes cracks in high-temperature conditions and cannot be practically used.

Adding the above-described additive to the tip is to increase the strength. However, to a greater or less extent, adding the additive possibly increases the spark exhaustion amount of the tip. Especially, if the ground electrode tip 45 includes an additive element, such as Pd and Ni, having a melting point lower than that of Pt, the spark exhaustion amount will increase greatly as understood from the data shown in FIG. 11.

From the foregoing, the test data shown in FIG. 11 derives the conclusion that it is preferable that all additives contained in the ground electrode tip 45 has a melting point higher than that of Pt. The spark exhaustion amount of the ground electrode tip 45 can be suppressed as less as possible. The strength of the ground electrode tip 45 can be increased.

The test data shown in FIG. 11 are based on the ground electrode tip 45 containing an additive selected from the group consisting of Rh, Ir, Pd, Ni, Ir—Rh, and Ir—Ni. However, the similar result will be obtained even if the ground electrode tip 45 contains other additive or even when the ground electrode tip 45 contains a plurality kinds of additives.

This is the reason why it is preferable that all additives contained in the ground electrode tip 45 has a melting point higher than that of Pt. Preferably, the element to be added to the ground electrode tip 45 should be selected from the group consisting of Ir, Rh, W, Ru, Os, $Y_2O_3$, and Re.

FIG. 12 is a table showing the relationship between various ground electrode tip compositions shown in FIG. 11 and measured bonding reliability of the ground electrode tips 45. The bonding reliability of respective ground electrode tips 45 was checked for each of resistance welding and laser welding to be applied to bond the tip 45 to the ground electrode 40.

For this evaluation, the spark plugs using respective ground electrodes 45 having compositions shown in FIG. 11 were installed on a 6-cylinder, 2000 cc engine to check the bonding reliability. The endurance test was performed for 100 hours by continuously repeating a predetermined driving cycle including 1-minute idling operation and 1-minute, fill-throttle, and high-speed (6,000 rpm) operation.

Figure 13A:
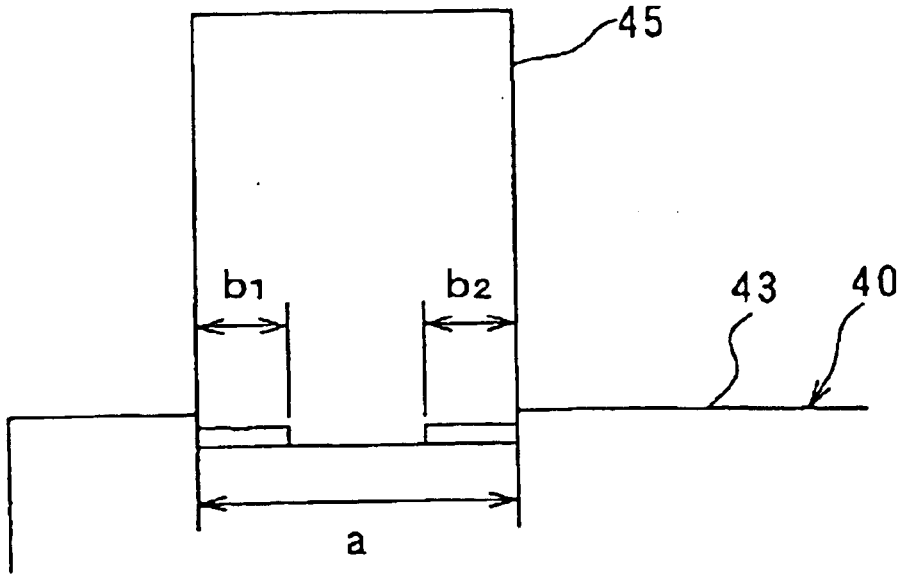
Figure 13B:
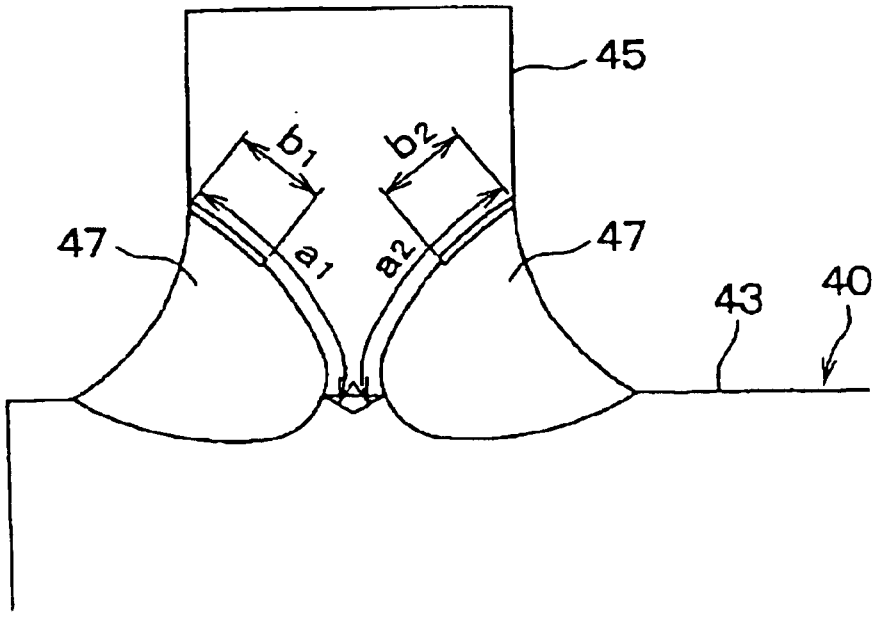

FIGS. 13A and 13B are views explaining a peel evaluation method employed for measuring the bonding reliability shown in FIG. 12. FIG. 13A is a cross-sectional view showing the ground electrode tip 45 bonded by resistance welding. FIG. 13B is a cross-sectional view showing the ground electrode tip 45 bonded by laser welding. In FIG. 13B, the laser welding forms a fused portion 47 which remains as a bonding region stretching between the ground electrode tip 45 and the ground electrode 40.

In FIG. 13A, a bonding length 'a' represents an original bonding interface extending between the tip 45 and the ground electrode 40. In FIG. 13B, two bonding lengths 'a1' and 'a2' represent original bonding interfaces extending between the tip 45 and the fused portion 47. In each of FIGS. 13A and 13B, peel lengths 'b1' and 'b2' represent the portions where no effective bonding was observed. The above lengths a, a1, a2, b1, and b2 or the conditions of bonded surfaces can be measured or known by using a metallurgical microscope or the like which is used to observe a cut surface taken along the bonding interface.

In the case of resistance welding shown in FIG. 13A, the peel rate is obtained according to a definition $\{(b1+b2)/a\}\times$ 100 (%). In the case of laser welding shown in FIG. 13B, the peel rate is obtained according to a definition {(b1+b2)/(a1+a2)}×100 (%).

Regarding the evaluations shown in the table of FIG. 12, mark '○' indicates that the measured peel rate was in the range from 0% to 25%. Mark 'Δ' indicates that the measured peel rate was in the range from 25% to 50%. And, mark '×' indicates that the measured peel rate was in the range from 50% to 100%.

From the evaluations of FIG. 12, the resistance welding cannot assure reliable bonding strength when the ground electrode tip includes only the additive, such as Rh and Ir, having a linear expansion coefficient smaller than that of Pt. Furthermore, there in the tendency that the evaluation result of bonding reliability shown in FIG. 12 is contrary to the spark exhaustion durability shown in FIG. 11.

Furthermore, as shown in the table 1, many of the additives having melting points higher than that of Pt have linear expansion coefficients smaller than that of Pt.

On the contrary, as apparent from the evaluations of FIG. 12, the laser welding can assure reliable bonding strength irrespective of compositions of ground electrode tips. Although the test data shown in FIG. 12 are based on the ground electrode tip 45 containing an additive selected from the group consisting of Rh, Ir, Pd, Ni, Ir—Rh, and Ir—Ni. However, the similar result will be obtained even if the ground electrode tip 45 contains other additive or even when the ground electrode tip 45 contains a plurality kinds of additives.

From the foregoing, to assure both of the spark exhaustion durability and the bonding reliability, the evaluation result of FIG. 12 derives the conclusion that it is preferable that all additives contained in the ground electrode tip 45 has a linear expansion coefficient smaller than that of Pt, and the ground electrode tip is fixed to the opposed surface 43 of the ground electrode 40 by laser welding.

Furthermore, to assure excellent ignitability and suppress oxidative and volatile exhaustion in the above-described second or third embodiment, it is preferable that the ground electrode tip 45 has the cross-sectional area 'A' not less than 0.1 $mm^2$ and not greater than 1.15 $mm^2$, and the protrusion amount 't' is not greater than 1.5 mm.

As apparent from the above-described third arrangement, the present invention provides a third spark plug including a center electrode (30), a ground electrode (40) disposed in an opposed relationship with the center electrode via a discharge gap (50), a noble metallic tip (35) fixed to an opposed surface (32) of the center electrode, and a noble metallic tip (45) fixed to an opposed surface (43) of the ground electrode, wherein the noble metallic tip (45) of the ground electrode protrudes from the opposed surface (43) of the ground electrode by a protrusion amount 't' not less than 0.3 mm, and the noble metallic tip (35) of the center electrode is made of an iridium alloy which contains iridium whose content exceeds 50% by weight and also contains at least one kind of additive, and the noble metallic tip (45) of the center electrode is made of a platinum alloy which contains platinum whose content exceeds 50% by weight and also contains at least one kind of additive.

According to the third spark plug of the present invention, the noble metallic tip of the center electrode is made of an iridium alloy which has a higher melting point and accordingly possesses robustness against the spark exhaustion. Meanwhile, the noble metallic tip of the ground electrode is made of a platinum alloy which has excellent oxidative and volatile resistance and accordingly possesses robustness against the oxidative and volatile exhaustion. Hence, it becomes possible to effectively improve the exhaustion resistance or durability of the noble metallic tips considering the difference of exhaustion mechanism of respective noble metallic tips provided on the center and ground electrodes.

Furthermore, according to the third spark plug of the present invention, it is preferable that the noble metallic tip (45) of the ground electrode (40) has a cross-sectional area 'A' not less than 0.1 $mm^2$ and not greater than 1.15 $mm^2$, and the protrusion amount 't' is not greater than 1.5 mm. The above-described reasons for the first spark having the same structural features are equally applicable to this arrangement of the third spark plug.

Furthermore, according to the third spark plug of the present invention, it is preferable that the additive contained in the noble metallic tips (35, 45) of the center electrode (30) and the ground electrode (40) is selected from the group consisting of Ir (iridium), Pt (platinum), Rh (rhodium), Ni (nickel), W (tungsten), Pd (palladium), Ru (ruthenium), Os (osmium), Al (aluminum), Y (yttrium), $Y_2O_3$ (yttrium oxide), and Re (rhenium). The number of additives selected from this group is not limited. It is also possible to select different additives for the noble metallic tip (35) of the center electrode (30) and for the noble metallic tip (45) of the ground electrode (40).

Furthermore, according to the third spark plug of the present invention, it is preferable that all additives contained in the noble metallic tip (45) of the ground electrode (40) has a melting point higher than that of Pt.

It may be preferable to use a pure Pt tip containing no additive for the ground electrode to assure excellent exhaustion resistance for the ground electrode. However, the pure Pt tip has insufficient strength and tends to cause cracks in high-temperature environment. Accordingly, the inventor proposes to use a Pt alloy containing at least one additive to assure sufficient tip strength.

In this case, adding the additive having a melting point higher than that of Pt makes it possible to obtain a noble metallic tip possessing practically acceptable exhaustion resistance comparable to the pure Pt tip (refer to FIG. 11).

Furthermore, according to the third spark plug of the present invention, it is preferable that all additives contained in the noble metallic tip (45) of the ground electrode (40) has a linear expansion coefficient smaller than that of Pt, and the noble metallic tip of the ground electrode is fixed to the opposed surface (43) of the ground electrode by laser welding.

This arrangement is preferable to simultaneously satisfy the requirements of the spark exhaustion resistance and boding reliability for the noble metallic tip for the ground electrode.

Especially, there is the tendency that additives having melting points higher than that of Pt have linear expansion coefficients smaller than that of Pt. Using the laser welding is effective to secure reliable bonding strength for such noble metallic tip containing an additive having a melting point higher than that of Pt (refer to FIG. 12).

As described above, employing any one of the above-described first to third arrangements in the spark plug S1 of this embodiment makes it possible to enhance the exhaustion resistance of the noble metallic tips and accordingly greatly increase the lifetime of spark plug.

Other Embodiments

The noble metallic tips 35 and 45, i.e., both of the center and ground electrode tips, can be configured into various shapes, such as a cylindrical rod shape (including an elliptic rod shape), a rectangular or square rod shape, a cone shape, a rivet shape, or any other shape. In any case, the above-described effects will be obtained.

Figure 14A:
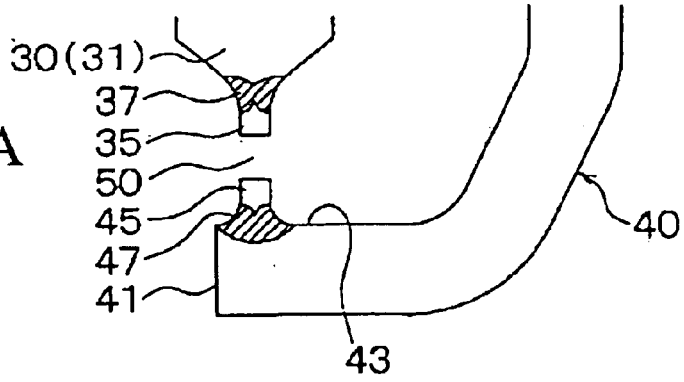
FIGS. 14A to 14D are enlarged views similar to FIG. 2 but showing various samples of welding patterns applicable to the noble metallic tip in accordance with the present invention.
Figure 14B:
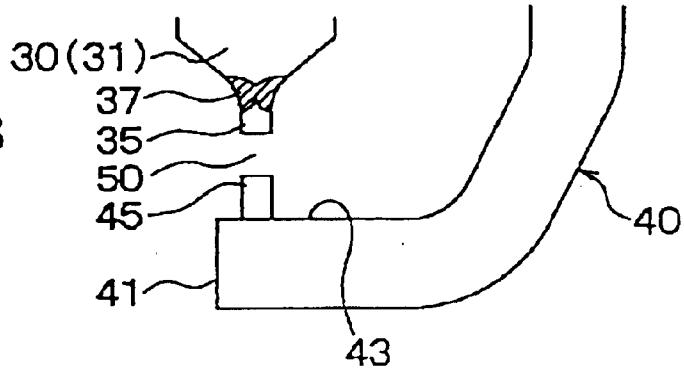
Figure 14C:
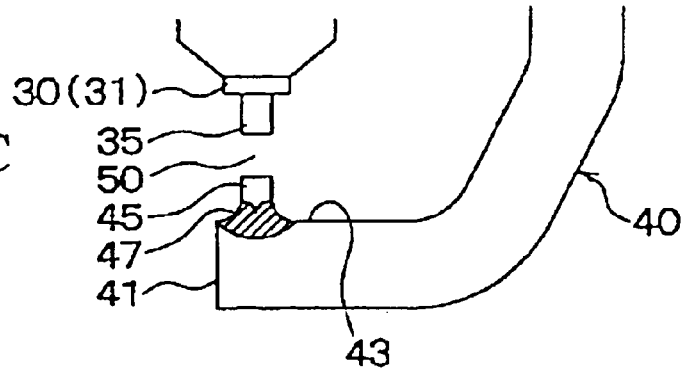
Figure 14D:
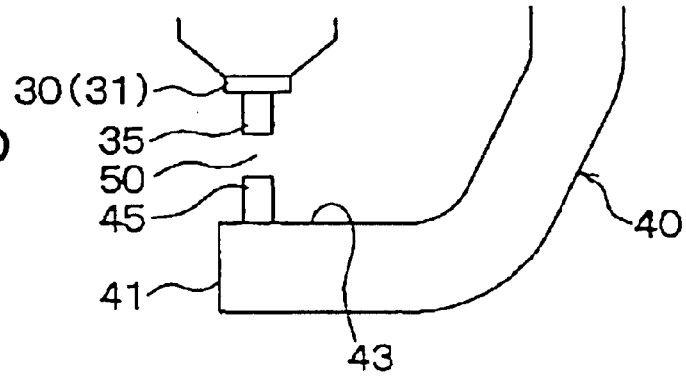

Furthermore, as shown in FIGS. 14A to 14D, the noble metallic tips 35 and 45 can be welded to the center electrode 30 and the ground electrode 40 by using any kind of welding method, such as laser welding, arc welding, and resistance welding. In FIGS. 14A to 14C, the fused portions 37 and 47 indicated by hitching are formed by laser welding or arc welding. Other welded portions indicated by no hatching are formed by resistance welding.

Figure 15A:
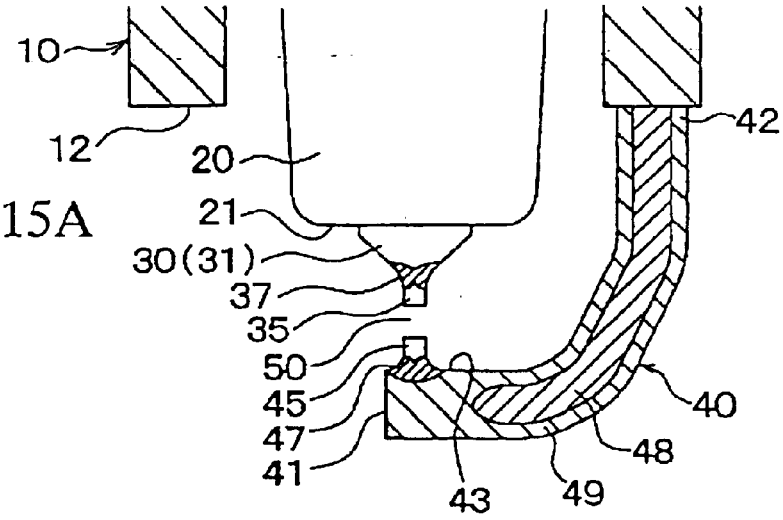
FIGS. 15A and 15B are enlarged views showing other materials employable for the ground electrode of the spark plug in accordance with the present invention.
Figure 15B:
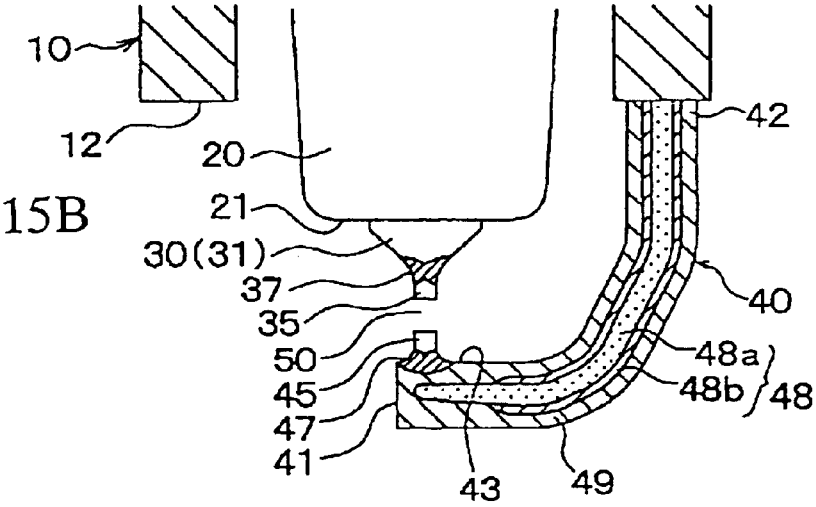

Furthermore, as shown in FIGS. 15A and 15B, it is preferable that the ground electrode 40 includes a core material 48 embedded in a base material 49. The core material 48 is a Cu or Cu—Ni clad having excellent heat conductivity compared with the base material 49. According to his arrangement, the temperature of the distal end 41 of ground electrode 40 can be reduced. As a result, it becomes possible to further suppress the oxidative and volatile exhaustion occurring at the ground electrode tip 45.

FIG. 15A shows a ground electrode 40 including a Cu core material 48 having excellent heat conductivity which is embedded in a base material 49 made of a Ni-base alloy. FIG. 15B shows a ground electrode 40 including a two-layered core material 48, consisting of an inner core member 48*a* and an outer core member 48*b*, embedded in a base material 49.

Figure 16:
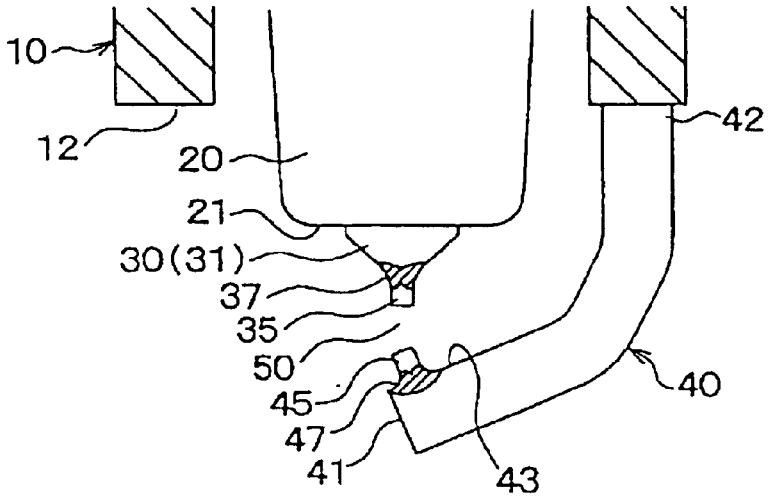
FIG. 16 is an enlarged view showing the arrangement of a modified ground electrode of the spark plug in accordance with the present invention.

Furthermore, as shown in FIG. 16, it is possible to adopt an inclined ground electrode 40. With this arrangement, the length of the ground electrode 40 can be shortened The temperature of a tip end can be reduced. As a result, it becomes possible to further suppress the oxidative and volatile exhaustion occurring at the ground electrode tip 45.

What is claimed is:

1. A spark plug comprising:

a center electrode;

a ground electrode disposed in an opposed relationship with said center electrode via a discharge gap;

a noble metallic tip fixed to an opposed surface of said center electrode; and a noble metallic tip fixed to an opposed surface of said ground electrode, wherein said noble metallic tip of said ground electrode protrudes from said opposed surface of said ground electrode by a protrusion amount 't' not less than 0.3 mm, and said noble metallic tip of said ground electrode possesses excellent oxidative and volatile resistance compared with said noble metallic tip of said center electrode.

2. The spark plug in accordance with claim 1, wherein an oxidized and volatilized ratio X, being defined as a ratio Lmax2/Lmax1, is not greater than 0.8, where Lmax1 represents a maximum oxidized and volatilized width of said noble metallic tip of the center electrode and Lmax2 represents a maximum oxidized and volatilized width of said noble metallic tip of the ground electrode observed after said noble metallic tip of the center electrode and said noble metallic tip of the ground electrode are left in the air for 30 hours at the temperature of 1,100° C.

3. The spark plug in accordance with claim 1, wherein said noble metallic tip of said ground electrode has a cross-sectional area 'A' not less than 0.1 $mm^2$ and not greater than 1.15 $mm^2$, and said protrusion amount 't' is not greater than 1.5 mm.

4. A spark plug comprising:

a center electrode;

a ground electrode disposed in an opposed relationship with said center electrode via a discharge gap;

a noble metallic tip fixed to an opposed surface of said center electrode; and a noble metallic tip fixed to an opposed surface of said ground electrode, wherein said noble metallic tip of said ground electrode protrudes from said opposed surface of said ground electrode by a protrusion amount 't' not less than 0.3 mm, each of said noble metallic tip of said center electrode and said noble metallic tip of said ground electrode is made of an iridium alloy which contains iridium whose content exceeds 50% by weight and also contains at least one kind of additive, and a total amount of all additives contained in said noble metallic tip of said ground electrode is not less than 15% by weight.

5. The spark plug in accordance with claim 4, wherein the total weight percentage of all additives contained in said noble metallic tip of said ground electrode is 1.5 times or more a total weight percentage of all additives contained in said noble metallic tip of said center electrode.

6. The spark plug in accordance with claim 4, wherein said noble metallic tip of said ground electrode has a cross-sectional area 'A' not less than 0.1 $mm^2$ and not greater than 1.15 $mm^2$, and said protrusion amount 't' is not greater than 1.5 mm.

7. The spark plug in accordance with claim 4, wherein said additives contained in said noble metallic tips of said center electrode and said ground electrode include at least one kind of additive selected from the group consisting of Ir, Pt, Rh, Ni, W, Pd, Ru, Os, Al, Y, $Y_2O_3$, and Re.

8. A spark plug comprising:

a center electrode;

a ground electrode disposed in an opposed relationship with said center electrode via a discharge gap;

a noble metallic tip fixed to an opposed surface of said center electrode; and a noble metallic tip fixed to an opposed surface of said ground electrode, wherein said noble metallic tip of said ground electrode protrudes from said opposed source of said ground electrode by a protrusion amount 't' not less than 0.3 mm, said noble metallic tip of said center electrode is made of an iridium alloy which contains iridium whose content exceeds 50% by weight and also contains at least one kind of additive, and said noble metallic tip of said ground electrode is made of a platinum alloy which contains platinum whose content exceeds 50% by weight and also contains at least one kind of additive.

9. The spark plug in accordance with claim 8, wherein said noble metallic tip of said ground electrode has a cross-sectional area 'A' not less than 0.1 $mm^2$ and not greater than 1.15 $mm^2$, and said protrusion amount 't' is not greater than 1.5 mm.

10. The spark plug in accordance with claim 8, wherein said additives contained in said noble metallic tips of said center electrode and said ground electrode include at least one kind of additive selected from the group consisting of Ir, Pt, Rh, Ni, W, Pd, Ru, Os, Al, Y, $Y_2O_3$, and Re.

11. The spark plug in accordance with claim 8, wherein all additives contained in said noble metallic tip of said ground electrode has a melting point higher than that of Pt.

12. The spark plug in accordance with claim 8, wherein all additives contained in said noble metallic tip of said ground electrode has a linear expansion coefficient smaller than that of Pt, and said noble metallic tip of said ground electrode is fixed to the opposed surface of said ground electrode by laser welding.

* * * * *